US010904680B2

(12) United States Patent
Karunasiri et al.

(10) Patent No.: US 10,904,680 B2
(45) Date of Patent: Jan. 26, 2021

(54) BATTERY-BASED SYSTEMS AND METHODS FOR MANAGING SOUND PROCESSOR PROGRAMMING FOR A COCHLEAR IMPLANT SYSTEM

(71) Applicant: Advanced Bionics AG, Staefa (CH)

(72) Inventors: R. Tissa Karunasiri, Valencia, CA (US); Szilard V. Gyalay, Moorpark, CA (US); Anthony J. Spahr, Santa Clarita, CA (US)

(73) Assignee: Advanced Bionics AG, Staefa (CH)

( * ) Notice: Subject to any disclaimer, the term of this patent is extended or adjusted under 35 U.S.C. 154(b) by 157 days.

(21) Appl. No.: 15/903,023

(22) Filed: Feb. 22, 2018

(65) Prior Publication Data

US 2018/0288536 A1 Oct. 4, 2018

Related U.S. Application Data

(60) Provisional application No. 62/462,833, filed on Feb. 23, 2017, provisional application No. 62/462,834, filed on Feb. 23, 2017, provisional application No. 62/462,835, filed on Feb. 23, 2017.

(51) Int. Cl.
*H04R 25/00* (2006.01)

(52) U.S. Cl.
CPC ..... *H04R 25/554* (2013.01); *H04R 25/50* (2013.01); *H04R 25/606* (2013.01); *H04R 25/70* (2013.01); *H04R 2225/31* (2013.01); *H04R 2225/55* (2013.01)

(58) Field of Classification Search
USPC ..... 607/58–59
See application file for complete search history.

(56) References Cited

U.S. PATENT DOCUMENTS

| | | | |
|---|---|---|---|
| 6,198,971 | B1 | 3/2001 | Leysieffer |
| 6,635,048 | B1 | 10/2003 | Ullestad et al. |
| 7,130,694 | B1 | 10/2006 | Voelkel |

(Continued)

FOREIGN PATENT DOCUMENTS

| | | |
|---|---|---|
| WO | 2008/092183 | 8/2008 |
| WO | 2015/092747 | 6/2015 |

*Primary Examiner* — Nicole F Lavert
(74) *Attorney, Agent, or Firm* — ALG Intellectual Property, LLC

(57) ABSTRACT

A sound processor assembly included within a cochlear implant system includes a sound processor and a battery assembly. The sound processor includes a physical computing device configured to direct operation of a cochlear implant in accordance with a sound processing program associated with a cochlear implant implanted within a patient. The battery assembly includes an electric battery configured to provide electrical power to the sound processor, as well as a storage facility configured to store the sound processing program associated with the cochlear implant. The storage facility is integrated with the electric battery within the battery assembly. The sound processor assembly also includes a bidirectional communication interface communicatively coupling the battery assembly to the sound processor to allow the sound processor to store data to, and to retrieve stored data from, the storage facility of the battery assembly by way of the bidirectional communication interface. Corresponding methods are also disclosed.

20 Claims, 21 Drawing Sheets

(56) References Cited

U.S. PATENT DOCUMENTS

| | | | | |
|---|---|---|---|---|
| 8,583,244 | B1 | 11/2013 | Calle et al. | |
| 8,630,432 | B2 | 1/2014 | Rass | |
| 8,694,112 | B2 | 4/2014 | Chapa et al. | |
| 8,812,125 | B2 | 8/2014 | Kaula et al. | |
| 9,613,028 | B2 | 4/2017 | Foo et al. | |
| 2005/0004618 | A1* | 1/2005 | Scott | A61N 1/37514 607/45 |
| 2008/0137889 | A1 | 6/2008 | Rass | |
| 2009/0222064 | A1 | 9/2009 | Faltys et al. | |
| 2012/0191161 | A1 | 7/2012 | Van Dijk | |
| 2013/0265144 | A1* | 10/2013 | Banna | H04R 25/554 340/12.5 |
| 2016/0243360 | A1 | 8/2016 | Spahr | |
| 2016/0310736 | A1 | 10/2016 | Calle et al. | |
| 2017/0078809 | A1 | 3/2017 | Solum et al. | |
| 2017/0099644 | A1 | 4/2017 | Kindred et al. | |

* cited by examiner

BATTERY-BASED SYSTEMS AND METHODS FOR MANAGING SOUND PROCESSOR PROGRAMMING FOR A COCHLEAR IMPLANT SYSTEM

RELATED APPLICATIONS

The present application claims priority under 35 U.S.C. § 119(e) to U.S. Provisional Patent Application No. 62/462,833, filed on Feb. 23, 2017, to U.S. Provisional Patent Application No. 62/462,834, filed on Feb. 23, 2017, and to U.S. Provisional Patent Application No. 62/462,835, filed on Feb. 23, 2017. The contents of each of these applications are hereby incorporated by reference in their respective entireties.

BACKGROUND INFORMATION

The natural sense of hearing in human beings involves the use of hair cells in the cochlea that convert or transduce acoustic signals into auditory nerve impulses. Some types of hearing loss (e.g., sensorineural hearing loss) may occur when hair cells in the cochlea are absent or damaged, such that auditory nerve impulses cannot be generated from acoustic signals in the natural way. To overcome these types of hearing loss, cochlear implant systems have been developed.

Cochlear implant systems generally include a sound processor assembly including a sound processor and a removably-coupled rechargeable battery for powering the sound processor. A typical sound processor assembly may be worn or carried by a patient external to the patient's body (e.g., worn behind the patient's ear), and may be communicatively coupled with a cochlear implant implanted within the patient. Powered by the battery, the sound processor may receive and process acoustic signals (e.g., sounds presented to the patient), and may direct the cochlear implant to bypass the hair cells in the cochlea by presenting electrical stimulation representative of the acoustic signals directly to auditory nerve fibers (e.g., by way of electrodes on a lead extending through the cochlea). In some examples, this electrical stimulation may be provided in accordance with a particular sound processing program loaded onto the sound processor and selected for use by the patient. This direct stimulation of the auditory nerve fibers as directed by the sound processor in accordance with the sound processing program may lead to the perception of sound in the brain and may result in at least partial restoration of hearing function for the patient.

BRIEF DESCRIPTION OF THE DRAWINGS

The accompanying drawings illustrate various embodiments and are a part of the specification. The illustrated embodiments are merely examples and do not limit the scope of the disclosure. Throughout the drawings, identical or similar reference numbers designate identical or similar elements.

DETAILED DESCRIPTION

Figure 1:
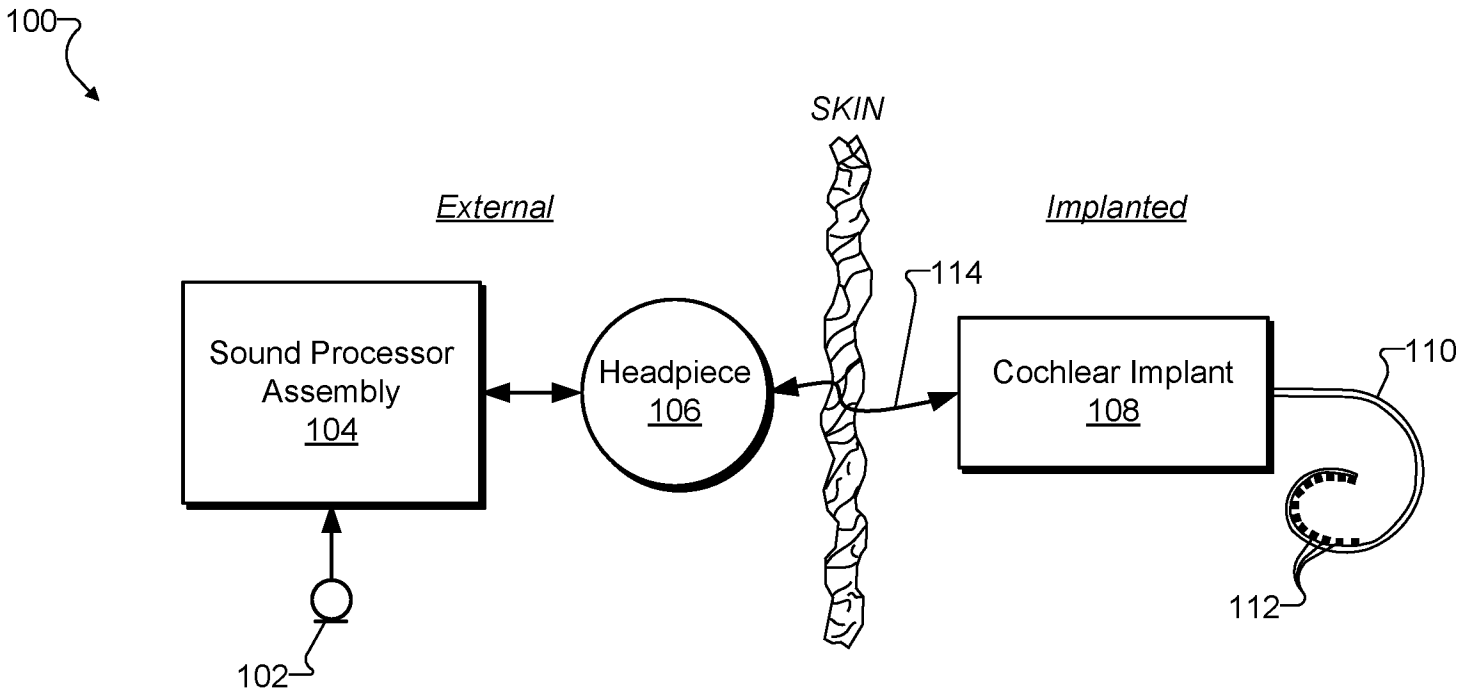
FIG. 1 illustrates an exemplary cochlear implant system according to principles described herein.

Battery-based systems and methods for managing sound processor programming for a cochlear implant system are described herein. For example, certain exemplary battery-based systems for managing (e.g., storing, providing, organizing, maintaining, etc.) sound processor programming for a cochlear implant system may be implemented by a sound processor assembly included within the cochlear implant system, or by a battery assembly included within such a sound processor assembly.

Specifically, for instance, an exemplary sound processor assembly may include a sound processor and a battery assembly physically and communicatively coupled to the sound processor. The sound processor may include at least one physical computing device configured to direct operation of a cochlear implant in accordance with a sound processing program associated with the cochlear implant. The cochlear implant may be implanted within a patient and may be further included (i.e., with the sound processor assembly) within the cochlear implant system. The battery assembly included within the sound processor assembly may include (e.g., within an enclosure that is separate from and removably-couplable to an enclosure of the sound processor) an electric battery, a storage facility, and a bidirectional communication interface. The electric battery may be configured, when the sound processor assembly is properly assembled such that the battery assembly is coupled to the sound processor, to provide electrical power to the sound processor. The storage facility may be configured to store the sound processing program associated with the cochlear implant, and may be integrated with the electric battery within the battery assembly (e.g., within the enclosure). The bidirectional communication interface may be configured to communicatively couple the battery assembly to the sound processor to allow the sound processor to store data to, and to retrieve stored data from, the storage facility of the battery assembly by way of the bidirectional communication interface.

In certain examples, a battery-based system for managing sound processor programming for a cochlear implant system may be implemented in a battery assembly that is configured to be used within a sound processor assembly such as described above. For example, like the battery assembly described above, such a battery assembly may include an electric battery configured to provide electrical power to a sound processor included within a cochlear implant system along with a cochlear implant implanted within a patient (e.g., wherein the sound processor is configured to direct operation of the cochlear implant in accordance with a sound processing program associated with the cochlear implant). The battery assembly may further include a storage facility configured to store the sound processing program associated with the cochlear implant. For example, the storage facility may be integrated with the electric battery within the battery assembly (e.g., within an enclosure of the battery assembly that contains some or all of the components of the battery assembly). The battery assembly may further include a bidirectional communication interface configured to communicatively couple the battery assembly to the sound processor so as to allow the sound processor to store data to, and to retrieve stored data from, the storage facility of the battery assembly by way of the bidirectional communication interface.

Battery-based systems and methods such as these may facilitate solving certain challenges that have long accompanied cochlear implant system use. For instance, a first challenge may relate to sound processing program synchronization. Specifically, because a typical sound processor assembly is detachable from the cochlear implant system to which it corresponds (e.g., by being implemented as a removable unit to be worn behind the ear, on the body, etc.), the sound processor may occasionally be lost or misplaced by a patient. Moreover, the sound processor may become damaged (e.g., by being dropped) or may otherwise malfunction. In these cases, a patient's sound processor may have to be replaced with a replacement sound processor. Unfortunately, replacing a broken, lost, or otherwise unusable sound processor may be an inconvenient, frustrating, and/or time-intensive task for a patient. This is in part because the replacement sound processor typically has to be configured with programming designed specifically for the patient and for the patient's particular cochlear implant. Such programming may require involvement from various parties such as the manufacturer of the replacement sound processor, a clinician associated with the patient, and/or others. As a result, the patient may have to wait for up to several days before the patient receives and/or is able to use the replacement sound processor.

A solution to this first challenge may be facilitated by battery-based systems and methods described herein. For example, referring to the sound processor assembly described above, the at least one physical computing device may be further configured to synchronize the sound processor and the storage facility of the battery assembly so that the patient may save and restore sound processing programs without the hassle of dealing with other parties such as the sound processor manufacturer or a clinician. Specifically, for instance, the at least one physical computing device within the sound processor may synchronize the sound processor and the storage facility of the battery assembly by performing some or all of the following operations in the sequence given or in another suitable sequence. First, the sound processor may detect an availability of an active communication link between the sound processor and the battery assembly by way of the bidirectional communication interface. Second, the sound processor may determine, by way of communication with the battery assembly over the active communication link, that the sound processing program is included on only one of the sound processor and the storage facility of the battery assembly. Third, the sound processor may initiate (e.g., in response to the determination) a synchronization transfer of the sound processing program by way of the active communication link to cause the sound processing program to be included on both the sound processor and the storage facility of the battery assembly.

By facilitating and/or performing this type of synchronization (e.g., sound processor-initiated synchronization) of sound processing programs, battery-based systems and methods for managing sound processor programming for a cochlear implant system may provide various benefits. For example, when sound processing programs are backed up to storage on the battery assembly for later synchronization from the battery assembly onto a different sound processor (e.g., a new replacement sound processor provided to the patient after a previous sound processor is misplaced, broken, or otherwise rendered unusable), a patient may be able to replace a sound processor with much less hassle and/or downtime (e.g., time when the user cannot hear, can only hear with one ear, etc.) than has been possible previously. For instance, as will be illustrated and described in more detail below, as soon as an order is received from a patient, a manufacturer may be able to immediately send the patient a "blank" replacement sound processor (e.g., a new sound processor that does not yet include any sound processing programs specifically associated with any particular cochlear implant or patient) using same-day shipping. Once the patient receives the replacement sound processor, the patient may couple the replacement sound processor to the battery assembly, and the replacement sound processor may automatically (or, in some examples, with certain involvement from the patient) synchronize with the battery assembly to cause the replacement sound processor to be programmed similarly or identically to the previous (i.e., broken or lost) sound processor.

Moreover, this simplified paradigm for replacing a sound processor may also benefit a manufacturer of the sound processor (who may benefit, for example, from a less complex and/or costly return merchandise authorization ("RMA") process), as well as clinicians and other personnel responsible for programming one or more sound processors for the patient (who may, for example, no longer need to be involved in replacing the sound processor at all).

Additionally, the battery-based systems and methods described herein may allow sound processors to have ready access to relatively large amounts of storage space that has not been available to the sound processors previously. This may benefit new sound processor designs by loosening design constraints for storage space that previously may have been relatively tight. It may be desirable for sound processors to have access to relatively large amounts of storage capacity for various reasons. For example, it may be desirable for a sound processor to have storage capacity capable of storing various sound processing programs associated with a particular cochlear implant (e.g., an implant in the patient's left ear). It may also be desirable for the sound processor to have sufficient storage capacity for storing various sound processing programs associated with one or more different cochlear implants (e.g., an implant in the patient's right ear, one or more implants belonging to one or more family members or friends of the patient, etc.) to be used as a backup for loss or failure of the other cochlear implants. Additionally, it may be desirable for the sound processor to have sufficient storage capacity to support transactionality of sound processing program updates. For example, when a sound processing program is updated or replaced (e.g., by a clinician), it may be desirable for an updated sound processing program to be fully and successfully loaded onto the sound processor prior to removing the previous (i.e., out-of-date) sound processing program from the sound processor.

Thus, by providing easy and convenient access to potentially large amounts of external data storage capacity, systems and methods described herein may allow new generations of sound processors to be designed without having to prioritize onboard data storage capacity at the expense of other features that may be added in increasingly constrained (e.g., size-constrained, power-constrained, cost-constrained, etc.) sound processor designs.

Along with this first challenge associated with sound processing program synchronization, battery-based systems and methods described herein may facilitate solving various other challenges associated with cochlear implant systems. For instance, a second challenge may relate to remote loading of a sound processing program onto a sound processor. Conventionally, sound processing programs loaded onto sound processors have been programmed and loaded onto the sound processors by professionals in clinical or manufacturing settings. For example, a manufacturer may preload one or more sound processing programs onto a new sound processor before shipping the sound processor to a particular patient, or a patient may meet with a clinician for an appointment and may provide subjective feedback to the clinician (e.g., as part of a fitting session during the appointment) to enable the clinician to program and load one or more sound processing programs onto the patient's sound processor for use by the patient after the appointment.

In certain examples, however, it may be inconvenient or impractical for a clinician or manufacturer to timely load new or updated sound processing programs onto sound processors in the conventional way. For instance, as described above, a sound processor may be lost or misplaced by the patient, may suffer accidental damage, or may otherwise need to be replaced for similar reasons. In other examples, a patient may wish to order an upgraded (e.g., next generation) sound processor directly from the manufacturer or a distributor, rather than through his or her clinician, or may to want to try a new sound processing program or an updated version of an existing sound processing program that is not yet loaded on the patient's sound processor. Similarly, a clinician may want the patient to try a new or updated sound processing program (e.g., based on a virtual appointment taking place over a telephone call, based on a previously set goal or milestone that the patient reaches, etc.). As such, in these and various other situations, it may be inconvenient, costly, time consuming, and/or frustrating for various parties (e.g., patients, clinicians, manufacturing personnel, etc.) to load desired sound processing programs onto sound processors in the conventional way.

A solution to this second challenge may also be facilitated by battery-based systems and methods described herein. For example, referring to the sound processor assembly described above, the at least one physical computing device may be further configured to remotely load the sound processing program onto the sound processor assembly (e.g., onto the sound processor and/or the battery assembly) so that the patient may receive sound processing programs from the manufacturer, the clinic, or another remotely-located entity without the hassle of physically bringing the sound processor assembly into proximity of the remotely-located entity. Specifically, for instance, the at least one physical computing device within the sound processor may remotely load the sound processing program onto the battery assembly by performing some or all of the following operations in the sequence given or in another suitable sequence. First, the sound processor may detect a unique identifier of the cochlear implant. Second, the sound processor may establish, by way of a network, an active network link with a remote computing system located remotely from the cochlear implant system. Third, the sound processor may transmit, to the remote computing system by way of the network and over the active network link, the unique identifier of the cochlear implant. Fourth, the sound processor may receive, in response to the transmission of the unique identifier, data representative of the sound processing program associated with the cochlear implant. For example, the data may be received from the remote computing system by way of the network and over the active network link. Fifth, the sound processor may store the received data representative of the sound processing program on the storage facility of the battery assembly by way of the bidirectional communication interface.

By facilitating and/or performing this remote loading of a sound processing program onto a sound processor, cochlear implant systems and people associated with them (e.g., patients, clinicians, etc.) may benefit in various ways. For example, systems and methods for remote loading of sound processing programs described herein may provide another convenient way (e.g., in addition or as an alternative to the synchronization described above) for a patient to replace lost or inoperative sound processors with much less hassle and/or downtime than has been possible previously. For instance, as will be illustrated and described in more detail below, as soon as an order is received from a patient, a manufacturer may be able to immediately send the patient a "blank" replacement sound processor using, for example, same-day shipping. Moreover, any of a variety of distribution centers around the country and the world may be used to fill the replacement sound processor order since the replacement sound processor is blank (i.e., the same generic sound processor available from all the other distribution centers). This may further decrease the patient's downtime, particularly if, for example, the patient is traveling away from home when the issues with the sound processor are experienced.

Moreover, as described above, this simplified paradigm for replacing a sound processor may also benefit a manufacturer of the sound processor (who may benefit, for example, from a less complex and/or costly return merchandise authorization ("RMA") process), as well as clinicians and other personnel responsible for programming one or more sound processors for the patient (who may, for example, no longer need to be involved in replacing the sound processor at all). These systems and methods may also allow new generations of sound processors to be backwards-compatible with previous sound processor generations. For example, as long as a new generation of sound processor is configured to properly couple with the cochlear implant of a particular patient, the new sound processor may conveniently load any sound processing programs that a patient or clinician may desire, even if the sound processor is different from (e.g., an upgrade from) a previous sound processor used by the patient.

Additionally, battery-based systems and methods described herein for remote loading of sound processing programs may facilitate more convenient interactions between patients and their caretakers (e.g., clinicians). For example, it may be possible for patients and clinicians to have "virtual" appointments (e.g., between regularly-scheduled in-person appointments) in which the clinician and patient communicate over a phone call or the like without the patient having to physically travel to the clinician's office to meet in person. Based on the patient's current status and needs, the clinician may provide the patient new sound processing programs or updates to existing sound processing programs that the patient may try in preparation for the next appointment or in response to issues the patient has been experiencing. In certain examples, the patient may also request (e.g., by way of a clinician-approved automated website) access to new sound processing programs that may improve the patient's hearing under particular circumstances or in specialized situations. In all of these examples, it may save time, effort, frustration, and/or costs for the patient to be able to receive access to new sound processing programs from home or on the road, rather than having to travel to meet the clinician in person and/or having to rely on the manufacturer to program a new sound processor for the patient.

Various embodiments will now be described in more detail with reference to the figures. The disclosed systems and methods may provide one or more of the benefits mentioned above and/or various additional and/or alternative benefits that will be made apparent herein.

FIG. 1 illustrates an exemplary cochlear implant system 100. As shown, cochlear implant system 100 may include various components configured to be located external to a cochlear implant patient including, but not limited to, a microphone 102, a sound processor assembly 104, and a headpiece 106. Cochlear implant system 100 may further include various components configured to be implanted within the patient including, but not limited to, a cochlear implant 108 (also referred to as an implantable cochlear stimulator) and a lead 110 (also referred to as an intracochlear electrode array) with a plurality of electrodes 112 disposed thereon. In certain examples, additional or alternative components may be included within cochlear implant system 100 as may serve a particular implementation. The components shown in FIG. 1 will now be described in more detail.

Microphone 102 may be configured to detect audio signals presented to the patient. Microphone 102 may be implemented in any suitable manner. For example, microphone 102 may include a microphone such as a T-MIC™ microphone from Advanced Bionics. Microphone 102 may be associated with a particular ear of the patient such as by being located in a vicinity of the particular ear (e.g., within the concha of the ear near the entrance to the ear canal). In some examples, microphone 102 may be held within the concha of the ear near the entrance of the ear canal by a boom or stalk that is attached to an ear hook configured to be selectively attached to sound processor assembly 104. Additionally or alternatively, microphone 102 may be implemented by one or more microphones disposed within headpiece 106, one or more microphones disposed within sound processor assembly 104, one or more beam-forming microphones, and/or any other suitable microphone or microphones as may serve a particular implementation.

Sound processor assembly 104 may include a sound processor, a battery assembly, and/or other components configured to interoperate so as to direct cochlear implant 108 to generate and apply electrical stimulation (also referred to herein as "stimulation current") representative of one or more audio signals (e.g., one or more audio signals detected by microphone 102, input by way of an auxiliary audio input port, etc.) to one or more stimulation sites associated with an auditory pathway (e.g., the auditory nerve) of the patient. Exemplary stimulation sites include, but are not limited to, one or more locations within the cochlea, the cochlear nucleus, the inferior colliculus, and/or any other nuclei in the auditory pathway. While, for the sake of simplicity, electrical stimulation will be described herein as being applied to one or both of the cochleae of a patient, it will be understood that stimulation current may also be applied to other suitable nuclei in the auditory pathway. To this end, sound processor assembly 104 may process the one or more audio signals in accordance with a selected sound processing strategy or program (i.e., a selected sound processing program) to generate appropriate stimulation parameters for controlling cochlear implant 108.

Sound processor assembly 104 may include or be implemented by a behind-the-ear ("BTE") unit, a body worn device, and/or any other sound processing unit as may serve a particular implementation. In certain examples, sound processor assembly 104 may be implemented by an electroacoustic stimulation ("EAS") sound processor included in an EAS system configured to provide electrical and acoustic stimulation to a patient. While not explicitly shown in FIG. 1, it will be understood that sound processor assembly 104 may include both a sound processor and a battery assembly coupled with the sound processor. For example, as will be described in more detail below in relation to FIG. 3, the battery assembly may provide power to the sound processor, as well as access to a storage facility and/or other computing resources.

In some examples, sound processor assembly 104 may wirelessly transmit stimulation parameters (e.g., in the form of data words included in a forward telemetry sequence) and/or power signals to cochlear implant 108 by way of a wireless communication link 114 between headpiece 106 and cochlear implant 108. It will be understood that communication link 114 may include a bidirectional communication link and/or one or more dedicated unidirectional communication links. In some examples, sound processor assembly 104 may execute and operate in accordance with a sound processing program that has been loaded into memory contained within sound processor assembly 104.

Headpiece 106 may be communicatively coupled to sound processor assembly 104 and may include an external antenna (e.g., a coil and/or one or more wireless communication components) configured to facilitate selective wireless coupling of sound processor assembly 104 to cochlear implant 108. Headpiece 106 may additionally or alternatively be used to selectively and wirelessly couple any other external device to cochlear implant 108. To this end, headpiece 106 may be configured to be affixed to the patient's head and positioned such that the external antenna housed within headpiece 106 is communicatively coupled to a corresponding implantable antenna (which may also be implemented by a coil and/or one or more wireless communication components) included within or otherwise associated with cochlear implant 108. In this manner, stimulation parameters and/or power signals may be wirelessly transmitted between sound processor assembly 104 and cochlear implant 108 via communication link 114.

Cochlear implant 108 may include any type of implantable stimulator that may be used in association with the apparatuses and methods described herein. For example, cochlear implant 108 may be implemented by an implantable cochlear stimulator. In some alternative implementations, cochlear implant 108 may include a brainstem implant and/or any other type of active implant or auditory prosthesis that may be implanted within a patient and configured to apply stimulation to one or more stimulation sites located along an auditory pathway of a patient.

In some examples, cochlear implant 108 may be configured to generate electrical stimulation representative of an audio signal processed by sound processor assembly 104 (e.g., an audio signal detected by microphone 102) in accordance with one or more stimulation parameters transmitted thereto by sound processor assembly 104. Cochlear implant 108 may be further configured to apply the electrical stimulation to one or more stimulation sites within the patient via one or more electrodes 112 disposed along lead 110 (e.g., by way of one or more stimulation channels formed by electrodes 112). In some examples, cochlear implant 108 may include a plurality of independent current sources each associated with a channel defined by one or more of electrodes 112.

Figure 2:
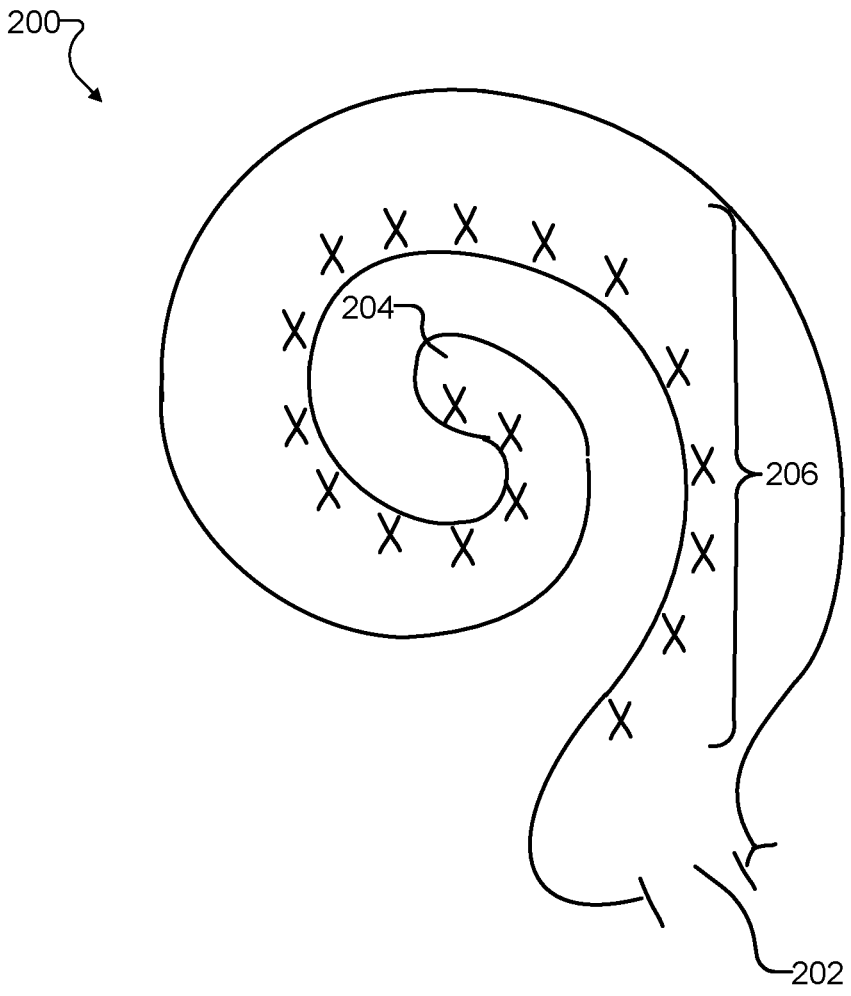
FIG. 2 illustrates a schematic structure of the human cochlea according to principles described herein.

FIG. 2 illustrates a schematic structure of a human cochlea 200 into which lead 110 may be inserted. As shown in FIG. 2, cochlea 200 is in the shape of a spiral beginning at a base 202 and ending at an apex 204. Within cochlea 200 resides auditory nerve tissue 206, which is denoted by Xs in FIG. 2. Auditory nerve tissue 206 is organized within cochlea 200 in a tonotopic manner. That is, relatively low frequencies are encoded at or near apex 204 of cochlea 200 (referred to as an "apical region") while relatively high frequencies are encoded at or near base 202 (referred to as a "basal region"). Hence, each location along the length of cochlea 200 corresponds to a different perceived frequency. Cochlear implant system 100 may therefore be configured to apply electrical stimulation to different locations within cochlea 200 (e.g., different locations along auditory nerve tissue 206) to provide a sensation of hearing to the patient. For example, when lead 110 is properly inserted into cochlea 200, each of electrodes 112 may be located at a different cochlear depth within cochlea 200 (e.g., at a different part of auditory nerve tissue 206) such that stimulation current applied to one electrode 112 may cause the patient to perceive a different frequency than the same stimulation current applied to a different electrode 112 (e.g., an electrode 112 located at a different part of auditory nerve tissue 206 within cochlea 200).

Figure 3:
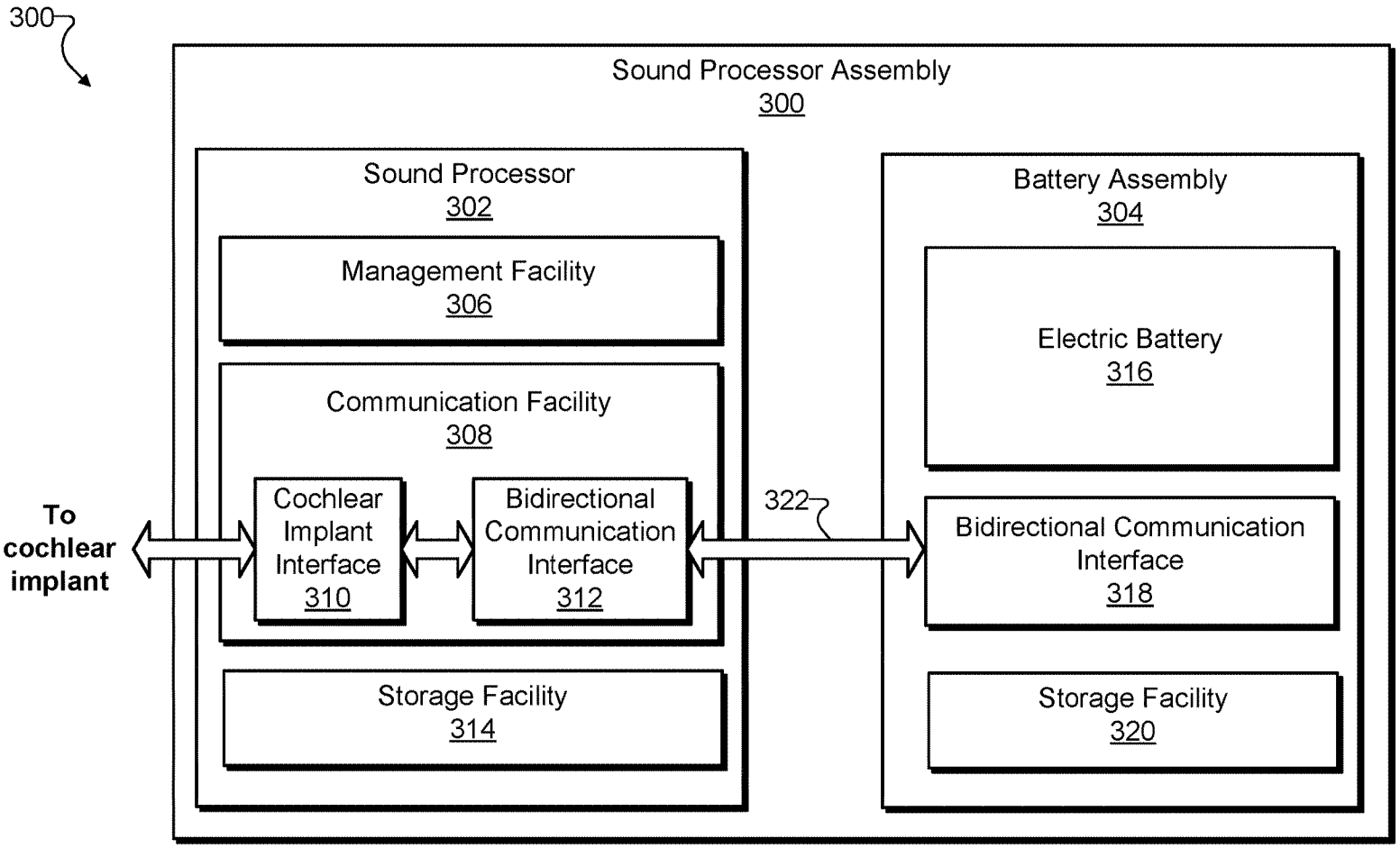
FIG. 3 illustrates a block diagram view of an exemplary sound processor assembly for managing sound processor programming for the cochlear implant system of FIG. 1 according to principles described herein.

As mentioned above, a sound processor assembly included within a cochlear implant system (e.g., sound processor assembly 104 within cochlear implant system 100) may include both a sound processor and a battery assembly that provides the sound processor access to a storage facility and/or other computing resources. To illustrate, FIG. 3 shows a block diagram view of an exemplary sound processor assembly 300 for managing sound processor programming for a cochlear implant system such as cochlear implant system 100. For example, sound processor assembly 300 may represent an exemplary implementation of sound processor assembly 104, described above in relation to cochlear implant system 100.

As shown in FIG. 3, sound processor assembly 300 may include, without limitation, a sound processor 302 and a battery assembly 304 communicatively coupled therewith. As shown, sound processor 302 may include, without limitation, a management facility 306, a communication facility 308 that includes a cochlear implant interface 310 and a bidirectional communication interface 312, and a storage facility 314 selectively and communicatively coupled to one another. It will be recognized that although facilities 306, 308, and 314 are shown to be separate facilities in FIG. 3, these facilities may be combined into fewer facilities, such as into a single facility, or divided into more facilities as may serve a particular implementation.

Additionally, as further shown in FIG. 3, battery assembly 304 may include, without limitation, an electric battery 316, a bidirectional communication interface 318, and a storage facility 320 selectively and communicatively coupled to one another. As with the facilities of sound processor 302, it will be recognized that although the illustrated components of battery assembly 304 are shown to be separate in FIG. 3, these components may be combined into fewer facilities, or divided into more facilities as may serve a particular implementation. Additionally, as will be illustrated, it will be understood that sound processor 302 and battery assembly 304 may each be housed within separate, removably-couplable housings or enclosures in any manner as may serve a particular implementation. As such, sound processor assembly 300 may be considered to be properly assembled when the enclosure within which battery assembly 304 is housed is physically coupled with the enclosure within which sound processor 302 is housed.

Each of the facilities and components of sound processor 302 and battery assembly 304, as well as a communicative link 322 shown to be communicatively coupling sound processor 302 and battery assembly 304, will now be described.

Management facility 306 of sound processor 302 may include any hardware (e.g., physical computing components such as processors, memories, application specific integrated circuits ("ASICs"), field programmable gate arrays ("FPGAs"), etc.) and/or software that facilitates directing operation of a cochlear implant in accordance with a sound processing program and as may serve a particular implementation. For example, management facility 306 may include hardware and/or software that, using data this is received or transmitted by way of communication facility 308 and/or is stored or retrieved by way of storage facility 314, performs any of the functionality described above in relation to sound processor assembly 104. In some examples, management facility 306 may include hardware and/or software configured to communicate with battery assembly 304 by way of bidirectional communication interface 312 and communicative link 322. For example, management facility 306 may communicate with battery assembly 304 to store data to or retrieve stored data from storage facility 320 of battery assembly 304 (e.g., as a backup storage facility, auxiliary storage facility, replacement storage facility, additional storage facility, etc., for storage facility 314 of sound processor 302).

In addition to performing operations related to data storage using battery assembly 304, management facility 306 may also manage communications with other components of the cochlear implant system (e.g., a microphone, a cochlear implant implanted within the patient, etc.) as described above in relation to FIG. 1. For example, management facility 306 may include hardware and/or software that detects or otherwise receives audio signals presented to the patient (e.g., by way of a microphone) and that prepares and/or otherwise processes the audio signals in accordance with sound processing programs (e.g., a sound processing program currently selected for use by the patient) to direct the cochlear implant to stimulate the patient. As such, management facility 306 may receive user input (e.g., from the patient) representative of a selection of a particular sound processing program (e.g., stored within storage facility 314 of sound processor 302 and/or stored within storage facility 320 of battery assembly 304).

For example, in response to the selection of the particular sound processing program, management facility 306 may send commands to the cochlear implant that may direct the cochlear implant to stimulate the patient in accordance with the selected sound processing program. For example, when the patient is in a noisy room, management facility 306 may, in accordance with the selected sound processing program, cause sound processor 302 to be optimized for the noise such as by implementing beamforming algorithms to help the patient focus in on particular sound sources (e.g., to better understand a person speaking directly in front of the patient). Conversely, when the patient is in a quieter room, management facility 306 may, in accordance with a different sound processing program, cause sound processor 302 to be optimized for the quiet by detecting and representing sounds in an omnidirectional manner. It will be understood that, in certain examples, the particular sound processing program may be automatically selected by sound processor 302, rather than by the patient or another user of sound processor assembly 300.

To facilitate these types of sound processing program selections, management facility 306 may also include hardware and/or software that manages sound processing programs included on sound processor 302 (e.g., by being stored within storage facility 314) and/or included on battery assembly 304 (e.g., by being stored within storage facility 320).

As one example of managing sound processing programs, management facility 306 may include environment classifier logic that identifies or classifies an acoustic environment surrounding a patient at a particular time and, based on the identified acoustic environment, facilitates switching (e.g., recommends switching, automatically switches, etc.) to a sound processing program customized for the identified acoustic environment. As another example of managing sound processing programs, management facility 306 may push or pull data (e.g., data representative of sound processing programs) to or from battery assembly 304. Such functionality stands in stark contrast to the functionality of conventional sound processors, which, at best, passively receive or provide data that is pushed or pulled by other devices (e.g., clinical programming systems, etc.). For example, in certain implementations, management facility 306 may initiate or otherwise facilitate a synchronization transfer of one or more sound processing programs to cause the sound processing programs to be included on both sound processor 302 and battery assembly 304.

As used herein, a "synchronization transfer" may refer to any transfer of data (e.g., sound processing programs) between a sound processor (e.g., sound processor 302) and a battery assembly coupled to the sound processor (e.g., battery assembly 304) that causes the sound processor and the battery assembly to become synchronized with one another. For example, as will be described in more detail below, a synchronization transfer may involve transmitting a copy of a file (e.g., a sound processing program) that is already included on one device (e.g., the sound processor) to the other (e.g., the battery assembly), if the latter does not already include the file. As another example, a synchronization transfer may involve transmitting data (e.g., a full file, a portion of a file, instructions for how to modify a file, etc.) to allow a device with a non-preferred version of a file (e.g., an out-of-date version of a sound processing program) to update or replace the non-preferred version of the file with a preferred version of the file (e.g., an up-to-date version of the sound processing program).

Communication facility 308 may include one or more communication interfaces by way of which sound processor 302 (e.g., management facility 306) may communicate with other cochlear implant system components, users, and the like. Specifically, as shown, communication facility 308 may include cochlear implant interface 310, which may provide an interface to communicate with other components of the cochlear implant system outside of sound processor assembly 300. For example, cochlear implant interface 310 may be used to send power and/or data (e.g., by way of a headpiece) to a cochlear implant that is implanted within the patient.

Communication facility 308 may also include bidirectional communication interface 312, which, as mentioned above, may be used to communicatively couple sound processor 302 with a battery assembly that includes a storage facility and an electric battery that provides electrical power to sound processor 302 (e.g., battery assembly 304). Bidirectional communication interface 312 may be implemented in any manner as may serve a particular implementation. For example, bidirectional communication interface 312 may be implemented as a bidirectional serial communication interface having no more than two wires by way of which communications are transmitted. More specifically, for instance, bidirectional communication interface 312 may include a 1-Wire serial interface, an $I^2C$ serial interface, a proprietary serial interface using only one or two wires, or another serial interface as may serve a particular implementation. In other examples, bidirectional communication interface 312 may be implemented as a bidirectional parallel interface (i.e., an interface including more than two wires), as a plurality of unidirectional serial or parallel communication interfaces (e.g., a unidirectional communication interface in each direction to and from sound processor 302), as a wireless communication interface, or as any other suitable communication interface as may serve a particular implementation.

Storage facility 314 may include or be implemented by any volatile or non-volatile storage and/or controller thereof that receives, provides, stores, and/or otherwise maintains any data as may serve a particular implementation of sound processor 302. However, as mentioned above, storage facility 314 in sound processor 302 may include only a relatively limited amount of storage capacity due to various design constraints and priorities, particularly in sound processor designs that are small, low-power, and/or feature-heavy. As a result, while storage facility 314 may be used to store some long-term data and/or to buffer data on a shorter-term basis, sound processor 302 may rely, in certain examples, on additional storage capacity included within battery assembly 304 (i.e., storage facility 320).

Referring now to the components of battery assembly 304 in FIG. 3, electric battery 316 may be implemented by or include one or more electrochemical cells capable of providing electrical power to sound processor 302, as well as to other components of battery assembly 304 that may consume electrical power (e.g., bidirectional communication interface 318, storage facility 320, etc.). In some examples, electric battery 316 may be a rechargeable battery. For example, the one or more electrochemical cells included in and/or implementing electric battery 316 may accumulate and store energy through a reversible electrochemical reaction such that the electrochemical cells may be recharged by an application of external power to electric battery 316 (e.g., from a battery charger or other device separate from sound processor assembly 300). Electric battery 316 may be implemented by a lithium-ion battery, a zinc-air battery, a silver-oxide battery, an alkaline battery, and/or any other type of rechargeable or non-rechargeable electric battery as may serve a particular implementation.

Bidirectional communication interface 318 of battery assembly 304 may communicatively couple battery assembly 304 with sound processor 302, and, like bidirectional communication interface 312 of sound processor 302, may be implemented in any suitable manner to communicatively couple battery assembly 304 to sound processor 302 to allow sound processor 302 to store data to, and retrieve stored data from, storage facility 320 by way of bidirectional communication interface 318. For example, bidirectional communication interface 318 may be configured to communicate using a common protocol with bidirectional communication interface 312 to allow bidirectional communication interface 318 and bidirectional communication interface 312 to intercommunicate, thereby establishing communication link 322 between battery assembly 304 and sound processor 302. More specifically, for instance, bidirectional communication interface 312 may be implemented as a bidirectional serial communication interface having no more than two wires by way of which communications are transmitted (e.g., using a 1-Wire serial interface, an $I^2C$ serial interface, a proprietary serial interface using only one or two wires, etc.). In other examples, bidirectional communication interface 312 may be implemented as a bidirectional serial or parallel interface, as a plurality of unidirectional serial or parallel communication interfaces, as a wireless communication interface, or as any other suitable communication interface as may serve a particular implementation.

Along with the components illustrated in FIG. 3, battery assembly 304 may include other components as may serve a particular implementation. For example, like sound processor 302 (e.g., management facility 306), battery assembly 304 may include hardware (e.g., physical computing components such as processors, memories, ASICs, FPGAs, etc.) and/or software configured to facilitate the managing of sound processor programming on battery assembly 304 in any suitable way. For example, such hardware and software may direct bidirectional communication interface 318 to transmit and receive messages with sound processor 302, to process and/or direct such messages (e.g., by suitably coordinating other components of battery assembly 304 in accordance with the messages), and the like. Additionally, hardware and/or software included within battery assembly 304 may perform operations related to receiving, processing, storing, or otherwise handling sound processing programs and/or other data from sound processor 302. For example, a physical computing component (e.g., a microprocessor or the like, a memory, hardware or software as described above, etc.) may interoperate with sound processor 302 (e.g., by way of both bidirectional communication interfaces 312 and 318) to perform operations related to sound processor-initiated synchronization of sound processing programs.

As another example of an additional component, battery assembly 304 may additionally or alternatively include hardware and/or software that tracks a current time (e.g., including both a current time of day and a current date representative of a current day, a current month, and a current year) and that provides data representative of the current time to sound processor 302 (e.g., by way of bidirectional communication interface 318). For example, a real-time data logging facility may be implemented by a specialized hardware module (e.g., a real-time clock chip, etc.), by a software module running on at least one physical computing component, by a combination of these, or in any other manner as may serve a particular implementation.

Storage facility 320 may be integrated with electric battery 316 within battery assembly 304 (i.e., both electric battery 316 and storage facility 320 may be implemented within the same enclosure or housing), and may include or be implemented by any volatile or non-volatile storage and/or controller thereof that receives, provides, stores, and/or otherwise maintains any data as may serve a particular implementation of battery assembly 304. For example, storage facility 320 may receive (e.g., by way of bidirectional communication interface 318) data from sound processor 302 representative of one or more sound processing programs and of a data storage request to store the one or more sound processing programs within storage facility 320. In response to the data storage request, storage facility 320 may store the one or more sound processing programs within storage facility 320. For example, as directed by sound processor 302, storage facility 320 may be used to store data generated or used by sound processor 302, but which may not fit within storage facility 314 of sound processor 302.

As described above, storage facility 314 of sound processor 302 may include volatile or non-volatile data storage capacity for storing and maintaining data received, generated, or used by sound processor assembly 300 for any suitable length of time. For example, storage facility 314 may maintain sound processing programs, along with any other data received, generated, managed, maintained, used, and/or transmitted by sound processor 302 in a particular implementation. More specifically, storage facility 314 may include sound processing programs associated with one or more cochlear implants. For example, certain sound processing programs stored within storage facility 314 may be associated with a cochlear implant in a first ear of a patient, while other sound processing programs may be associated with a cochlear implant in a second ear (i.e., the other ear) of the patient. Additionally, yet other sound processing programs may be associated with cochlear implants used by other patients (e.g., family members of the patient who may wish to share sound processor 302 in the event that they misplace or otherwise render unusable their own sound processors).

However, while all of the types of data described above may theoretically be stored within storage facility 314 of sound processor 302, in practice, the storage capacity available within storage facility 314 may be limited. For example, as new generations of sound processors are designed to be ever smaller, lower-power, and less intrusive than previous generations, designing in large amounts of storage capacity may require ever greater sacrifice of other design goals. As a result, certain implementations of sound processor 302 (e.g., newer implementations prioritizing small size, low power, etc.) may include relatively little storage capacity (or no storage capacity) within storage facility 314 for storing sound processing programs. As a result, these implementations of sound processor 302 may be configured to rely on battery assembly 304 for storing some or all of the sound processing programs and/or other data that might otherwise be stored within storage facility 314. For example, sound processor 302 may use storage facility 320 within battery assembly 304 as an overflow memory, a scratchpad memory, a backup memory, or the like, for offloading, backing up, or otherwise storing data stored on storage facility 314 and/or data that may not fit within the limited storage capacity of storage facility 314.

Figure 4:
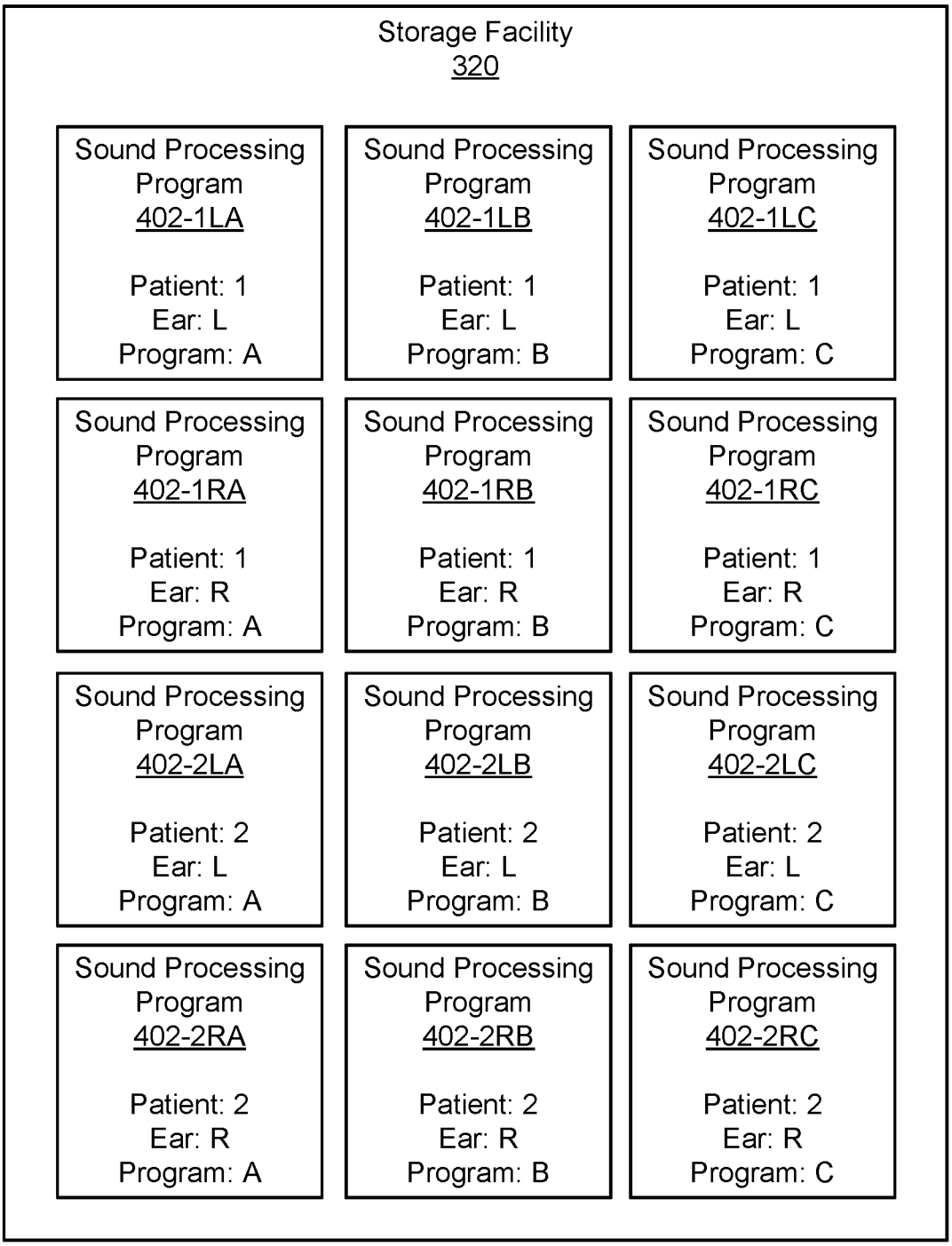
FIG. 4 illustrates exemplary sound processing programs included within the storage facility of the battery assembly included within the sound processor assembly of FIG. 3 according to principles described herein.

FIG. 4 illustrates exemplary sound processing programs included within storage facility 320 of battery assembly 304 included within sound processor assembly 300, described above. Specifically, as shown, storage facility 320 may store various sound processing programs 402 (i.e., sound processing programs 402-1LA, 402-1LB, 402-1LC, 402-1RA, 402-1RB, 402-1RC, 402-2LA, 402-2LB, 402-2LC, 402-2RA, 402-2RB, and 402-2RC), as well as any other sound processing programs and/or other data as may serve a particular implementation (not explicitly shown).

As used herein, "sound processing programs" may refer to any data stored within, accessible to, and/or used by a sound processor (e.g., a sound processor included within a cochlear implant system). In particular, sound processing programs may refer to datasets (e.g., files, etc.) including personalized and/or customized data associated with a particular cochlear implant within the cochlear implant system. In some examples, a sound processing program may represent a particular program (e.g., methodology, technique, etc.) by which an incoming audio signal is to be processed and prepared prior to being used by the particular cochlear implant to stimulate the patient. For example, a sound processing program may include a discrete dataset that is customized to direct the particular cochlear implant in accordance with unique needs and/or preferences of a patient using the cochlear implant in different types of listening environments. Specifically, for instance, different electrical parameters, channel mappings, dynamic ranges, electrode settings, microphone directionality settings, and/or other parameters and settings may be set in different sound processing programs to optimize the operation of the cochlear implant for relatively noisy or relatively quiet listening environments, for relatively large or relatively small rooms (e.g., having more or less echo and/or reverberation), for listening to music, for listening to speech, for listening to an auxiliary audio input, and/or for any other listening scenario or listening environment as may serve a particular implementation.

As described above, it may be desirable in various situations for a sound processor to have access not only to sound processing programs associated with a cochlear implant with which the sound processor is associated, but also to have access to sound processing programs associated with other cochlear implants. For example, by storing various sound processing programs, a battery assembly such as battery assembly 304 may act as a backup device that may be shared between cochlear implants used by the same patient and/or even between cochlear implants used by different patients. For instance, a battery assembly may be transferrable to be used on either a left or a right sound processor of a patient as may be convenient. Thus, battery assembly 304 may store a plurality of sound processing programs including one or more alternative sound processing programs associated with a first cochlear implant associated with a first ear of a patient, one or more alternative sound processing programs associated with a second cochlear implant associated with a second ear of the patient (i.e., a contralateral cochlear implant implanted within the same patient), at least one sound processing program associated with another cochlear implant associated with a particular ear of a different patient (i.e., a second patient distinct from the first patient), and/or any other sound processing programs associated with any other cochlear implants as may serve a particular implementation.

To illustrate, FIG. 4 shows various sound processing programs 402 annotated to indicate three characteristics of the sound processing programs. First, each sound processing program 402 is annotated with a "Patient" who is implanted with the cochlear implant to which the sound processing program 402 pertains. Specifically, in the example of FIG. 4, a first patient is indicated as Patient '1', while a second patient is indicated as Patient '2'. Second, each sound processing program 402 is annotated with a particular "Ear" of the patient with which the cochlear implant to which the sound processing program pertains is associated. Specifically, in the example of FIG. 4, an 'L' is used to indicate a cochlear implant associated with the left ear of the particular patient, while an 'R' is used to indicate a cochlear implant associated with the right ear of the patient. Third, each sound processing program 402 is annotated with a particular "Program" that is represented by the sound processing program. Specifically, different programs 'A', 'B', and 'C' may be available for each ear of each patient in the example of FIG. 4. For example, as described above, programs 'A', 'B', and 'C' may represent different types of programs optimized for noisy environments, quieter environments, auxiliary audio input, music listening, and so forth as may serve a particular implementation.

As shown in FIG. 4, each sound processing program 402 is named in such a way as to indicate the three characteristics of the sound processing program 402 described above. For example, sound processing program 402-1LA includes a '1', an 'L' and an 'A' to indicate that sound processing program 402-1LA represents a program of type 'A' (e.g., for noisy environments) associated with (e.g., customized for) a cochlear implant in the left ear of patient '1'. Accordingly, as described above, FIG. 4 illustrates that storage facility 320 may include sound processing programs for different purposes, different ears of a particular patient, and/or for different patients. It will be understood that the sound processing programs 402 illustrated in storage facility 320 in FIG. 4 are for illustration purposes only. In other examples, more, fewer, or different sound processing programs may be stored within storage facility 320. In certain examples, as will be illustrated below, storage facility 320 may not include any sound processing programs 402 prior to a first synchronization transfer between a sound processor and a battery assembly.

Returning to FIG. 3, subsequent to the storage of one or more of sound processing programs 402 stored on storage facility 320 within battery assembly 304, sound processor 302 may activate a selected sound processing program 402 on sound processor 302 in any suitable way. For example, if sound processor assembly 300 is properly assembled with battery assembly 304 being coupled with sound processor 302 such that communicative link 322 between battery assembly 304 and sound processor 302 is functional, management facility 306 of sound processor 302 may (e.g., by way of communication facility 308, communication interfaces 312 and 318, and communicative link 322) retrieve the selected sound processing program 402 from storage facility 320 of battery assembly 304. Upon retrieving the selected sound processing program 402, management facility 306 may direct (e.g., by way of communication facility 308 and cochlear implant interface 310) the cochlear implant to stimulate the patient in accordance with the selected sound processing program 402.

Figure 5:
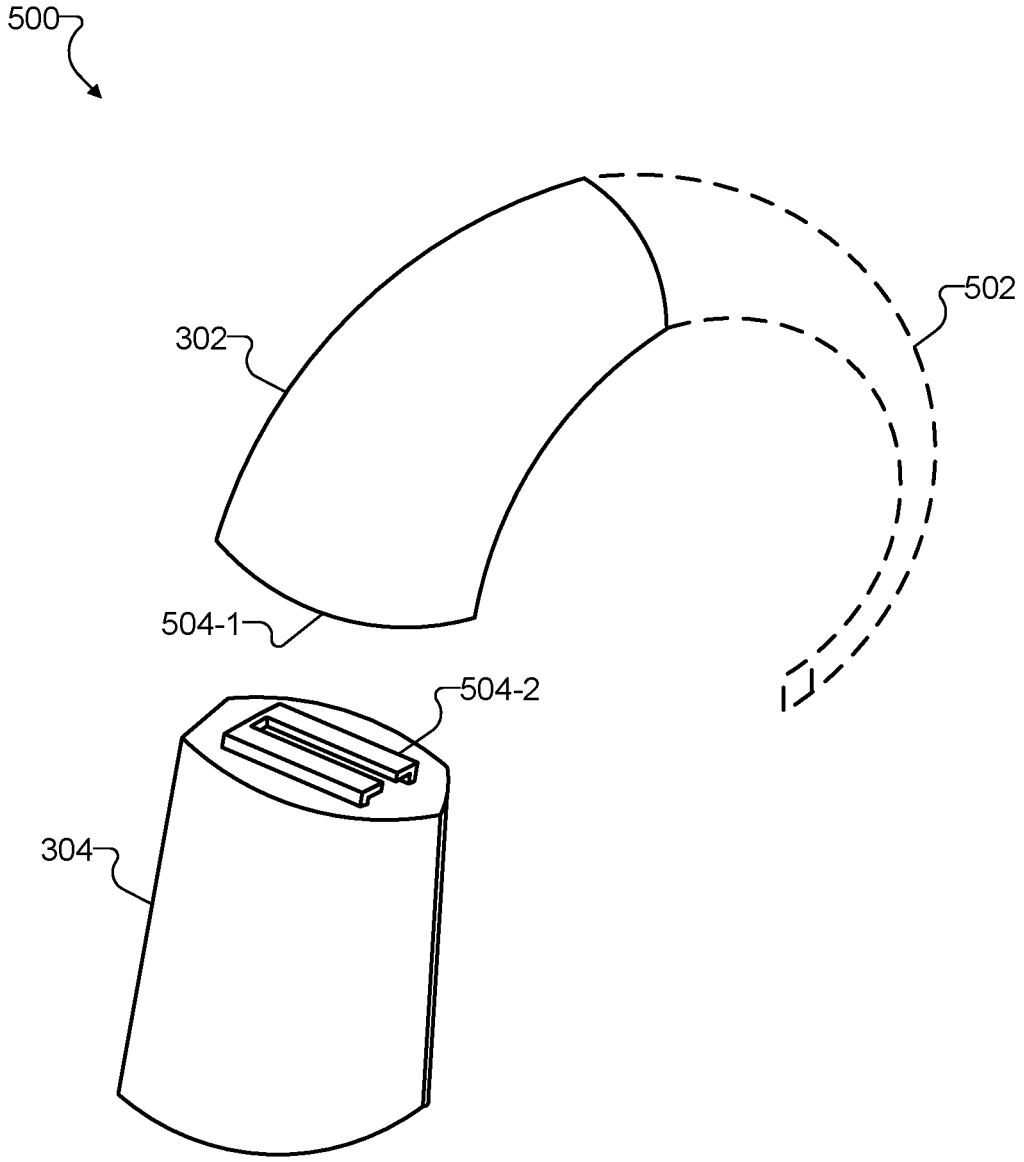
FIG. 5 illustrates an exemplary implementation of the sound processor assembly of FIG. 3 according to principles described herein.

FIG. 5 illustrates an exemplary implementation 500 of sound processor assembly 300. Specifically, as shown, implementation 500 includes sound processor 302 and battery assembly 304 each fully housed in separate, removably-couplable enclosures. Implementation 500 of sound processor assembly 300 may be included within any cochlear implant system as may serve a particular implementation. For example, implementation 500 may serve as the sound processor for a unilateral cochlear implant system or as one of the sound processors for a bilateral cochlear implant system. In examples where implementation 500 is included within a cochlear implant system (e.g., cochlear implant system 100), implementation 500 may be coupled (e.g., communicatively coupled) with other components similar to or the same as components of cochlear implant system 100 (e.g., microphone 102, headpiece 106, cochlear implant 108, etc.). Additionally, in some examples, implementation 500 of sound processor assembly 300 may also be coupled with components of a cochlear implant system not explicitly shown or described with respect to cochlear implant system 100. For example, as illustrated in FIG. 5, implementation 500 may be coupled with an earhook 502, which may facilitate a patient in wearing implementation 500 of sound processor assembly 300 behind the ear.

Implementation 500 of sound processor assembly 300 may facilitate managing sound processor programming for a cochlear implant system when sound processor 302 is coupled to battery assembly 304. Sound processor 302 may couple to battery assembly 304 in any way as may serve a particular implementation. For example, as illustrated in FIG. 5, sound processor 302 and battery assembly 304 may connect by way of a coupling mechanism 504 (i.e., including respective portions 504-1 on sound processor 302 and 504-2 on battery assembly 304) that may facilitate (e.g., by sliding, locking, etc.) proper coupling and seating of battery assembly 304 with sound processor 302. It will be recognized that sound processor 302 and battery assembly 304 may connect using an intervening cable assembly and/or any other suitable component as may serve a particular implementation. In some examples, sound processor 302 and battery assembly 304 may be removably coupled such that, for example, battery assembly 304 may be selectively detached from sound processor 302 and then reattached to sound processor 302 at a later time.

Removably coupled battery assemblies may be useful for various reasons. For example, an electric battery included within battery assembly 304 may be a rechargeable battery, and battery assembly 304 may be detached from sound processor 302 to allow battery assembly 304 to be coupled with a battery charger to charge the rechargeable battery. In other examples, battery assembly 304 may connect to a computing device (e.g., by way of a USB dongle or the like) to allow data stored within a storage facility on battery assembly 304 to be read out, backed up, updated, or the like (e.g., by a clinician when the patient attends a clinical visit), to allow a real-time clock module included on battery assembly 304 to be set or updated (e.g., for Daylight Savings Time, etc.), or for any other purpose as may serve a particular implementation.

In some examples, a patient may own several battery assemblies similar to or the same as battery assembly 304, all of which may be attached and detached from sound processor 302 to form sound processor assembly 300 as may be appropriate or desirable (e.g., depending on which battery assemblies are charged, are in need of charging, are storing particular sound processing programs, etc.).

When sound processor 302 is properly mechanically coupled with battery assembly 304 (e.g., by way of coupling mechanism 504 or in another suitable manner), sound processor 302 may also be communicatively coupled with battery assembly 304. For example, as described above, sound processor 302 may include bidirectional communication interface 312, battery assembly 304 may include bidirectional communication interface 318, and sound processor 302 may communicate (i.e., send and/or receive data) with battery assembly 304 by way of these bidirectional communication interfaces over communicative link 322 formed between the bidirectional communication interfaces.

Sound processing programs may be generated for particular cochlear implants within particular cochlear implant patients in any suitable way. For example, one or more generic, undifferentiated sound processing programs that are configured to work reasonably well for various types of patients in various situations may be preloaded onto certain sound processors at a time of manufacturing. As another example, sound processing programs customized for use in specific situations by specific cochlear implants implanted within specific patients may be generated by audiologists and/or other practitioners who may work with patients in a clinical setting (referred to herein as "clinicians").

Figure 6:
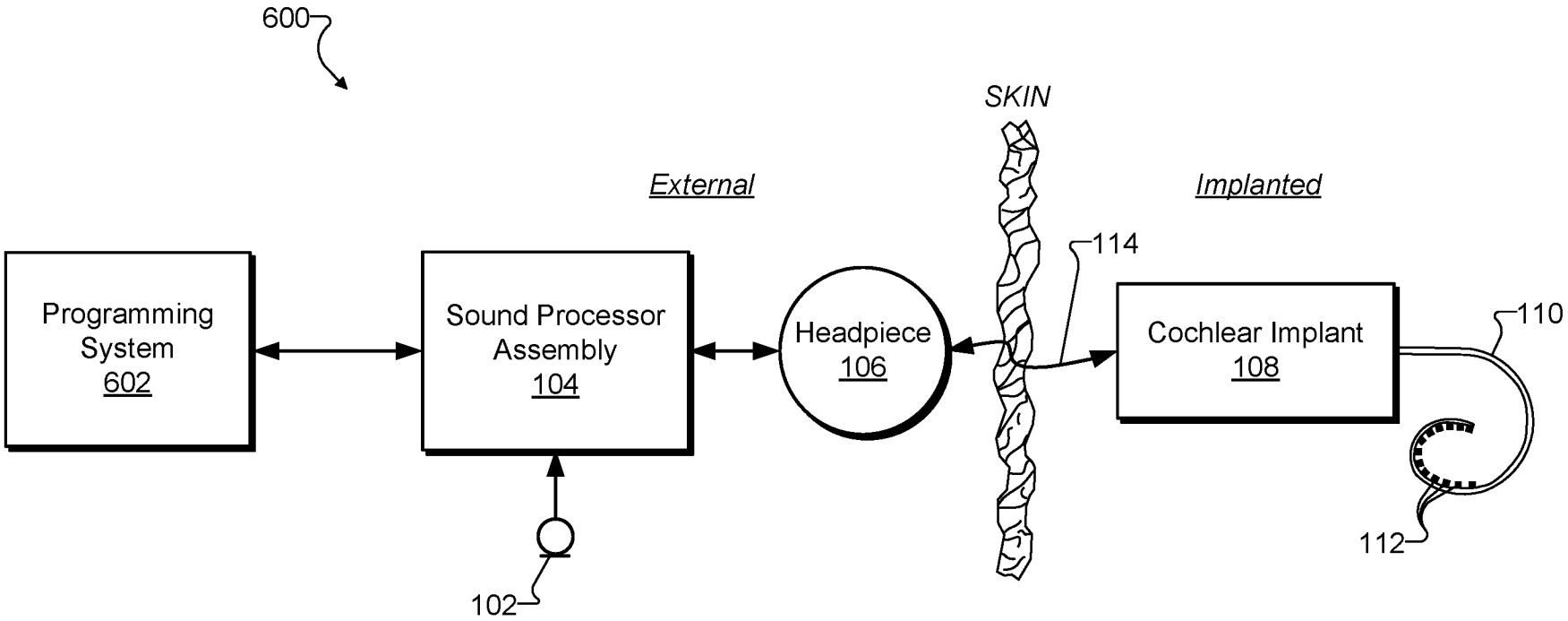
FIG. 6 shows an exemplary configuration in which a programming system is communicatively coupled to the cochlear implant system of FIG. 1 according to principles described herein.

For example, to illustrate how a clinician may develop and generate a particular sound processing program for a particular cochlear implant of a particular patient, FIG. 6 shows an exemplary configuration 600 in which a programming system 602 is communicatively coupled to cochlear implant system 100. As shown, programming system 602 may be separate from (i.e., not included within) cochlear implant system 100, and may be selectively and communicatively coupled to sound processor assembly 104 in order to perform one or more programming or fitting operations with respect to cochlear implant system 100. For example, during a fitting session, a clinician may use the programming system to present audio clips to the patient by way of the cochlear implant system in order to facilitate evaluation of how well the cochlear implant system is performing for the patient.

To this end, programming system 602 may be implemented by any suitable combination of physical computing and communication devices including, but not limited to, a fitting station or device, a programming device, a personal computer, a laptop computer, a handheld device, a mobile device (e.g., a mobile phone), a clinician's programming interface ("CPI") device, and/or any other suitable component as may serve a particular implementation. In some examples, programming system 602 may provide one or more graphical user interfaces ("GUIs") (e.g., by presenting the one or more GUIs by way of a display screen) with which a clinician or other user may interact.

Figure 7:
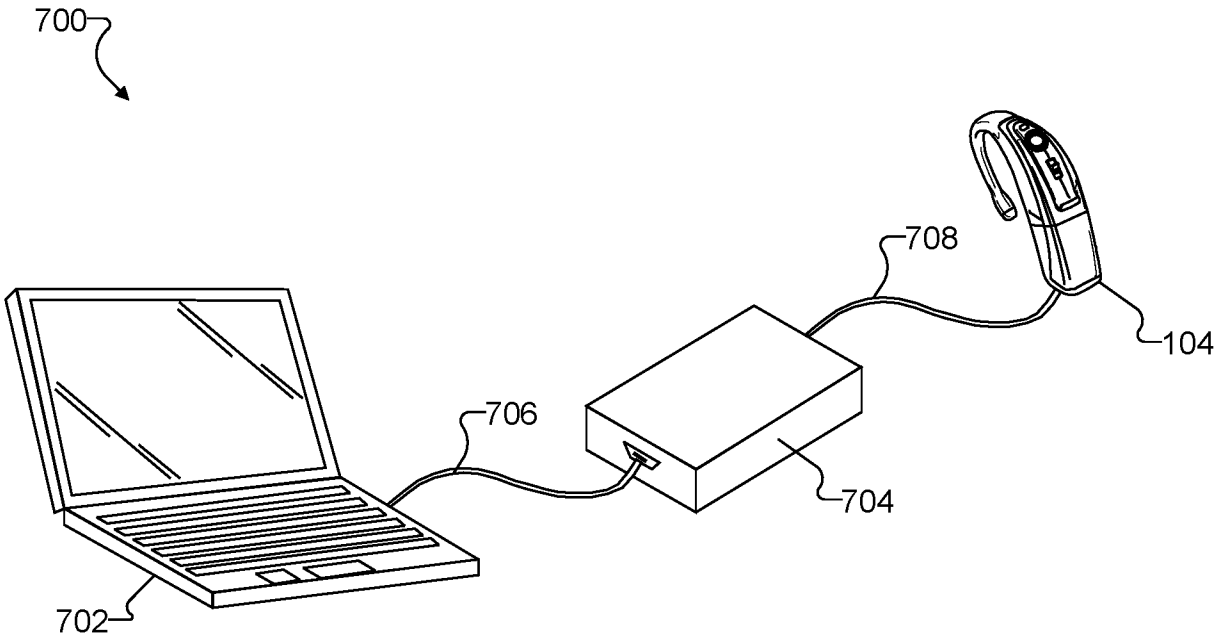
FIG. 7 illustrates an exemplary implementation of the programming system shown in FIG. 6 according to principles described herein.

FIG. 7 illustrates an exemplary implementation 700 of programming system 602 as programming system 602 is coupled to cochlear implant system 100 (i.e., to sound processor assembly 104). In FIG. 7, programming system 602 is implemented by a computing device 702 and a CPI device 704. During a programming or fitting session with respect to cochlear implant system 100, as shown, computing device 702 may be selectively and communicatively coupled to CPI device 704 by way of a cable 706. Likewise, CPI device 704 may be selectively and communicatively coupled to sound processor assembly 104 by way of a cable 708. Cables 706 and 708 may each include any suitable type of cable that facilitates transmission of digital data between computing device 702 and sound processor assembly 104. For example, cable 706 may include a universal serial bus ("USB") cable and cable 708 may include any type of cable configured to connect to a programming port included in sound processor assembly 104. In some examples, computing device 702 may present an audio clip to the patient by digitally streaming the audio clip to sound processor assembly 104 by way of cable 706, CPI device 704, and cable 708 without the audio clip ever being converted to an analog signal. In some alternative examples, wireless connections may be used to communicatively couple computing device 702 and CPI device 704, as well as CPI device 704 and sound processor assembly 104.

Implementation 700 is shown to correspond to a unilateral cochlear implant system (i.e., because there is a single sound processor assembly 104 that corresponds to one ear of the patient). It will be recognized, however, that the systems and methods described herein may be applied to a bilateral cochlear implant system in which separate sound processors are associated with each ear of the patient or by a bimodal system in which a sound processor is associated with one of the patient's ears and a hearing aid is associated with the patient's other ear. In these instances, programming system 602 may be implemented by two CPI devices each associated with one of the sound processors.

As described above, sound processing programs managed by a sound processor may be associated with a particular cochlear implant (e.g., a specific cochlear implant implanted within a specific ear of a specific patient). For example, one or more specific sound processing programs associated with the particular cochlear implant (e.g., generated and/or determined by a clinician in a fitting session such as described above with respect to FIGS. 6 and 7) may be loaded onto a sound processor configured to be linked with the particular cochlear implant within a cochlear implant system.

Conventionally, such sound processing programs may be preloaded onto a sound processor by a manufacturer, or may be loaded onto the sound processor in a clinical setting (e.g., by a clinician subsequent to a fitting session). In certain situations, however, it may be desirable for specific sound processing programs to be loaded onto a sound processor in other ways. For example, it may be desirable in certain scenarios for sound processing programs to be loaded onto sound processors being used by patients within their own home. In one such scenario, for instance, accidental damage to a sound processor may result in data loss of sound processing programs stored within a sound processor, or a sound processor may be misplaced by the patient, accidentally destroyed, and/or otherwise rendered unusable such that a new sound processor may be needed as a replacement of the sound processor that was misplaced or destroyed. In these examples, as described above, it may be desirable for a sound processing program to be restored (e.g., from a backup copy) onto a current sound processor or loaded onto a different sound processor (e.g., a new replacement sound processor). Additionally or alternatively, new sound processing programs (or new versions of existing sound processing programs) may be available that the patient and/or his or her clinician may desire to be loaded onto a sound processor, but it may be inconvenient for the patient to visit the clinic to obtain the new sound processing program.

Figure 8:
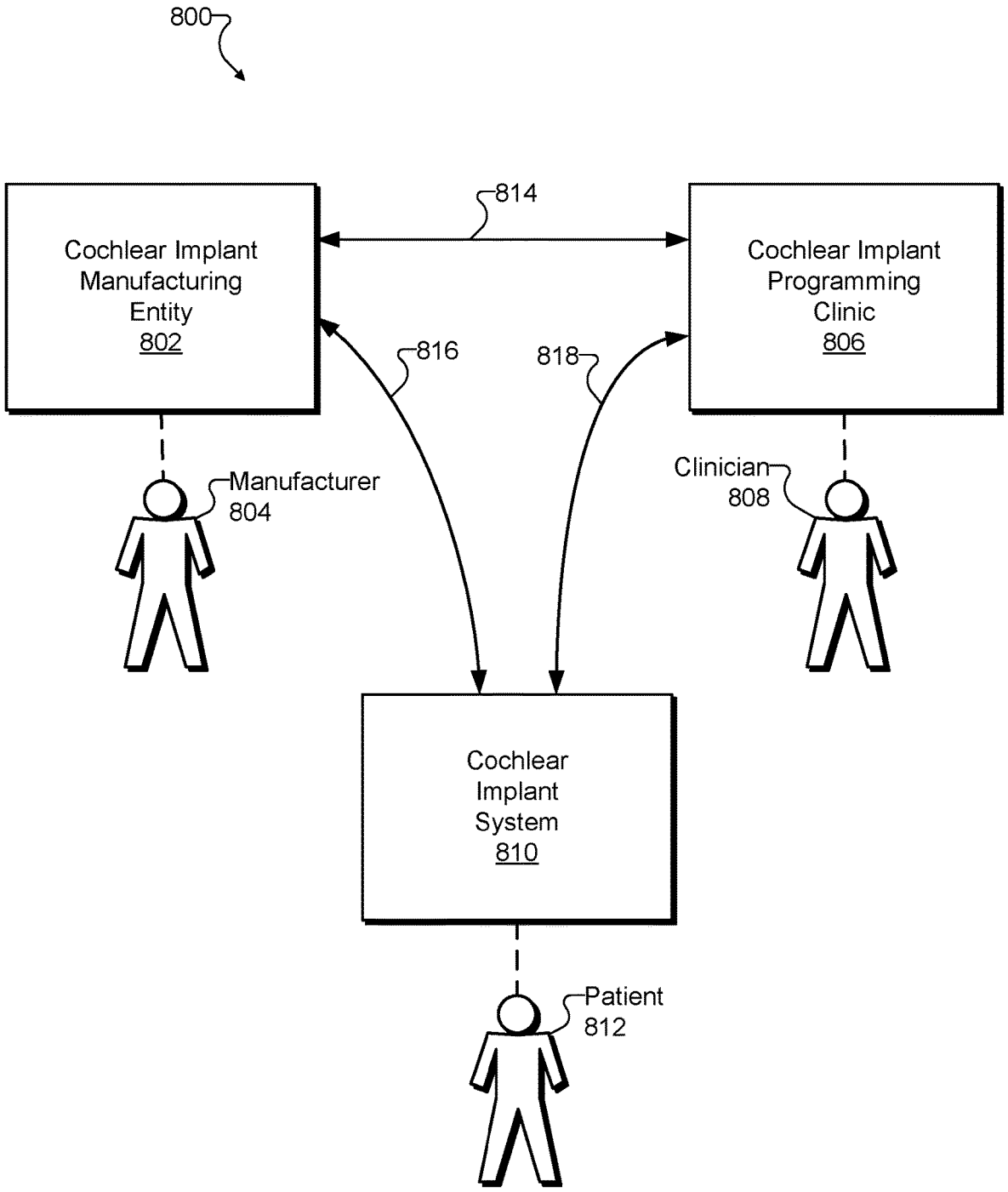
FIGS. 8 and 9 illustrate exemplary procurement flows for replacing sound processors within a cochlear implant system such as the cochlear implant system illustrated in FIG. 1 according to principles described herein.

To illustrate why conventional sound processing program loading paradigms may be inconvenient or undesirable, FIG. 8 illustrates an exemplary procurement flow 800 for replacing a sound processor assembly within a cochlear implant system such as sound processor assembly 104 within cochlear implant system 100. As shown, procurement flow 800 includes a cochlear implant manufacturing entity 802 ("manufacturing entity 802") associated with (e.g., controlled by, etc.) one or more personnel that are represented in FIG. 8 by a manufacturer 804. Procurement flow 800 further includes a cochlear implant programming clinic 806 ("programming clinic 806") associated with (e.g., controlled by, etc.) one or more personnel that are represented in FIG. 8 by a clinician 808. Additionally, procurement flow 800 includes a cochlear implant system 810 associated with (e.g., owned by, used by, controlled by, etc.) a patient 812.

Manufacturing entity 802 may represent a manufacturer, distributor, reseller, retail outlet, or other entity that may provide (e.g., sell or otherwise distribute) a sound processor such as a sound processor used by patient 812 (e.g., a replacement for a sound processor included within cochlear implant system 810 that has been misplaced, destroyed, or otherwise rendered unusable). In some examples, manufacturing entity 802 may be a company that designs and manufactures cochlear implant system 810 (e.g., including the sound processor included within the cochlear implant system), or may be closely associated with such a company. In alternative examples, manufacturing entity 802 may provide components of cochlear implant system 810 (e.g., including the sound processor), but may not actually be responsible for the design or manufacture of the cochlear implant system components. Manufacturing entity 802 may be capable of providing (e.g., shipping, etc.) both preprogrammed sound processors (i.e., sound processors upon which customized sound processing programs associated with particular cochlear implants or patients is stored) and blank sound processors (i.e., sound processors upon which no customized sound processing programs associated with particular cochlear implants or patients is stored). As will be described below, however, in procurement flow 800, manufacturing entity 802 may provide only a preprogrammed sound processor to patient 812 so that the sound processor will be ready for use by patient 812 without further programming.

Programming clinic 806 may represent any clinic, business, practice, or other entity that works with patients such as patient 812 to program (e.g., fit) cochlear implant systems such as cochlear implant system 810. For example, as described above, personnel such as clinician 808 may work with patients to determine characteristics of the patients' unique hearing abilities, preferences, etc., and program the patients' respective cochlear implant systems to operate in accordance with these characteristics (e.g., by generating customized sound processing programs for the cochlear implant systems). As such, patient 812 may attend periodic appointments at programming clinic 806 to allow clinician 808 to determine, track, and promote the progress of patient 812 with respect to cochlear implant system 810. To this end, programming clinic 806 may store (e.g., within physical files, within data stored on server computers, etc.) records related to patient 812 and the progress of patient 812 with regard to cochlear implant system 810. For example, records of the progress of patient 812, along with past and current sound processing programs, past and current characteristics unique to the patient's hearing abilities and preferences, and other suitable data specific to patient 812 may be maintained within programming clinic 806 (e.g., by clinician 808).

Cochlear implant system 810 may be a unilateral or a bilateral cochlear implant system (e.g., including one cochlear implant and one sound processor, or including two cochlear implants and two sound processors, respectively) that may be used by patient 812. For example, cochlear implant system 810 may be similar to or the same as cochlear implant system 100, described above with respect to FIG. 1. Patient 812 is described herein as being the person who both uses cochlear implant system 810 and is responsible for replacing the sound processor of cochlear implant system 810 when the sound processor is rendered unusable. However, it will be understood that, in certain examples (e.g., when patient 812 is a child), a person other than the patient wearing cochlear implant system 810 may be responsible for replacing the sound processor. In such examples, patient 812 may represent both the actual cochlear implant patient as well as one or more other people who assist the patient in matters pertaining to cochlear implant system 810, such as parents or guardians of the actual cochlear implant patient.

As shown, procurement flow 800 includes various transactions, including a transaction 814 involving manufacturing entity 802 and programming clinic 806, a transaction 816 involving manufacturing entity 802 and cochlear implant system 810, and a transaction 818 involving programming clinic 806 and cochlear implant system 810. It will be understood that transactions such as transactions 814 through 818 may be performed in any order as may serve a particular implementation, and that more or fewer transactions than described herein may be included within a particular implementation of a procurement flow. For example, each of transactions 814 through 818 may represent one transaction or multiple transactions between the relevant entities or systems as will be described below.

Procurement flow 800 may begin when patient 812 determines that he or she needs to obtain a replacement sound processor for cochlear implant system 810. For example, as mentioned above, the sound processor included within cochlear implant system 810 may suffer accidental damage (e.g., water damage, shock damage, etc.), may cease working properly (i.e., with or without a known cause), may be misplaced or destroyed, and/or may otherwise be rendered unusable. Upon determining that the sound processor is unusable and needs to be replaced, patient 812 may contact programming clinic 806 in transaction 818 to order a replacement sound processor.

Upon receiving the order for the replacement sound processor, clinician 808 may review the visit history of patient 812, review previous sound processing programs that have been uploaded onto the sound processor included within cochlear implant system 810, and designate particular sound processing programs (e.g., from a particular visit by patient 812 to programming clinic 806) to include on the replacement sound processor. Clinician 808 may generate a new sound processor request that includes data representative of the particular sound processing programs designated to be included on the replacement sound processor. For example, the request may take the form of an RMA ticket that includes an export file representative of the sound processing programs designated to be loaded on the replacement sound processor. Clinician 808 may transmit the request for the new sound processor (e.g., along with the designated sound processing programs, the export file, etc.) to manufacturing entity 802 as part of transaction 814.

In other examples, patient 812 may contact manufacturing entity 802 directly in transaction 816 to order the replacement sound processor. In these examples, manufacturer 804 may request and receive proper sound processing programs to include on the replacement sound processor from programming clinic 806 via transaction 814.

It is noted, however, that regardless of whether patient 812 requests a replacement sound processor directly from manufacturing entity 802 or from programming clinic 806, procurement flow 800 relies on clinician 808 to designate the sound processing programs that are to be included on the replacement sound processor. Due to this reliance on clinician 808, procurement flow 800 inherently leaves room for human error. For example, clinician 808 may accidentally load an incorrect export file (e.g., an export file for a different patient), accidentally designate an incorrect sound processing program to be included on the replacement sound processor (e.g., an out-of-date sound processing program that patient 812 used previously rather than a current sound processing program), accidentally neglect to include one or more of the sound processing programs that patient 812 expects to be included on his or her sound processor, and/or otherwise designate or transmit to manufacturing entity 802 improper sound processing programs.

Once manufacturing entity 802 receives a request (e.g., an RMA ticket) for the replacement sound processor, manufacturer 804 may determine, based on the request, what sound processor (e.g., which sound processor model, version, etc.) is to be shipped to patient 812. Because various models and versions of sound processors may be available, manufacturing entity 802 may be required to maintain software, including legacy software, for loading sound processing programs onto various sound processors. Accordingly, manufacturer 804 must locate the proper sound processor requested by patient 812 and/or clinician 808 and use a proper version of software to properly format and load the designated sound processing programs onto the sound processor. Here again, due to reliance on manufacturer 804 to select a proper sound processor, a proper format, and to correctly load proper sound processing programs (i.e., those sound processing programs designated by clinician 808), procurement flow 800 leaves room for human error which may delay the process if patient 812 receives the wrong sound processor or a sound processor with the wrong sound processing programs.

Moreover, even if no human error is introduced by clinician 808 or manufacturer 804 (as should typically be the case), procurement flow 800 may occur over an inconveniently long timeframe. For example, all the steps of procurement flow 800 described above may take at least two to three days. Thus, even if a properly configured replacement sound processor is sent to patient 812 in transaction 816 using fast shipping methods (e.g., same-day shipping), patient 812 still may have had to endure several days without a working sound processor in cochlear implant system 810. In certain examples, this may mean that patient 812 was unable to hear for several days while waiting for procurement flow 800 to be fully performed.

Figure 9:
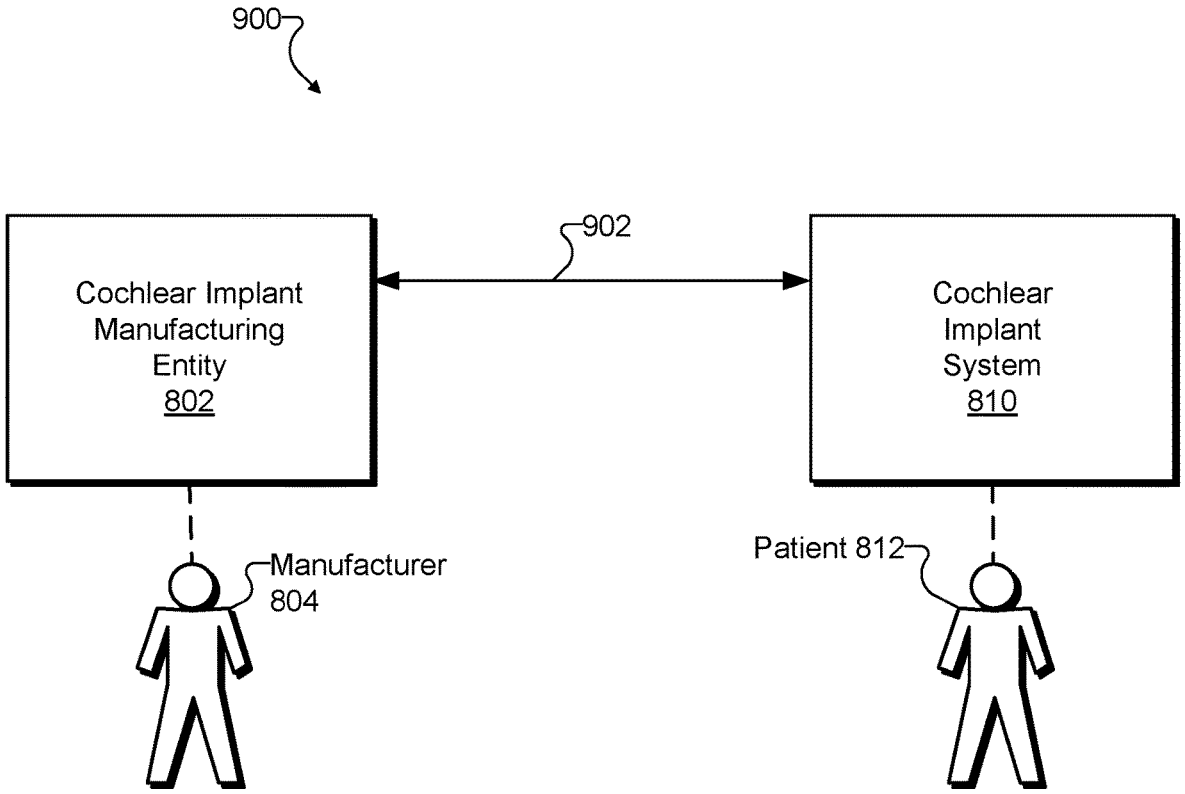

FIG. 9 illustrates another exemplary procurement flow 900 for replacing the sound processor within cochlear implant system 810. In contrast to procurement flow 800, which may illustrate a conventional procurement flow for replacing a sound processor within a cochlear implant system, procurement flow 900 illustrates a simpler, faster, more convenient, and more cost-effective procurement flow enabled by systems and methods for managing sound processor programming for a cochlear implant system disclosed herein, particularly as such systems and methods relate to sound processor-initiated synchronization of sound processing programs.

Specifically, as shown in FIG. 9, procurement flow 900 may only involve manufacturer entity 802 and cochlear implant system 810, and may remove programming clinic 806 and clinician 808 from the flow completely. Specifically, as illustrated by a transaction 902, upon determining that a replacement sound processor is needed, patient 812 may order the replacement sound processor directly from manufacturing entity 802. Manufacturer 804 may receive the order for the new sound processor directly from patient 812 and immediately ship the requested sound processor (e.g., a blank, unprogrammed unit of the sound processor model, version, etc., requested by patient 812) to patient 812 by way of transaction 902. Upon receiving the new sound processor, patient 812 may connect the new sound processor to a backup device such as battery assembly 304 that maintains the sound processor programs for patient 812 and may thereby restore the exact sound processing programs that had been included on the previous sound processor (i.e., the misplaced or unusable sound processor being replaced) before the previous sound processor was rendered unusable. The synchronization transfers involved in this type of scenario will be described in more detail below.

In procurement flow 900, there may be less room for human error than in procurement flow 800. Significantly, clinician 808 has been removed from the flow completely due to the ability of patient 812 to synchronize sound processor programming using battery assemblies that store the patient's sound processing programs. Additionally, in certain examples, the sound processor identification and shipping performed with respect to manufacturing entity 802 may be partially or fully automated to free up manufacturer 804 to perform other tasks and to eliminate even more opportunities for human error. Additionally, due to the simplicity of procurement flow 900, a replacement sound processor may be distributed to patient 812 relatively quickly (e.g., in one day or less), significantly minimizing the amount of downtime patient 812 has to endure while waiting to receive the replacement sound processor.

In order to implement procurement flow 900, sound processor assembly 300 may include (as was described above) both a sound processor and a removable battery assembly capable of acting as a backup device. In this way, sound processor assembly 300 may store and backup sound processing programs that are received via conventional means (e.g., from the manufacturer, from a clinician after a fitting session, etc.), and then may restore such sound processing programs in the event that such sound processing programs are not available on storage facility 314 of sound processor 302 (e.g., because the sound processing programs do not fit within the limited storage capacity of sound processor 302, because sound processor 302 is a new replacement sound processor, etc.). To this end, various synchronization operations between sound processor 302 and battery assembly 304 may be performed by sound processor assembly 300.

As used herein, "sound processor-initiated synchronization" of sound processing programs may refer to various aspects of a data synchronization (e.g., data transfer, data backup, etc.) process that includes, for example, synchronizing sound processing programs from the sound processor to storage within a battery assembly and/or from the battery assembly storage to the sound processor insofar as the data synchronization process is "initiated" by (e.g., instigated by, triggered by, controlled by, etc.) the sound processor and/or the battery assembly, rather than by other systems that may not be under direct control of the patient such as systems owned and/or operated by parties other than the patient (e.g., a programming system operated by a clinician who has previously programmed the sound processor for the patient or by a manufacturer or distributor of the sound processor).

Various synchronization operations used to implement synchronization transfers (e.g., sound processor-initiated synchronization transfers) to provide the benefits of procurement flow 900 will now be described.

Figure 10:
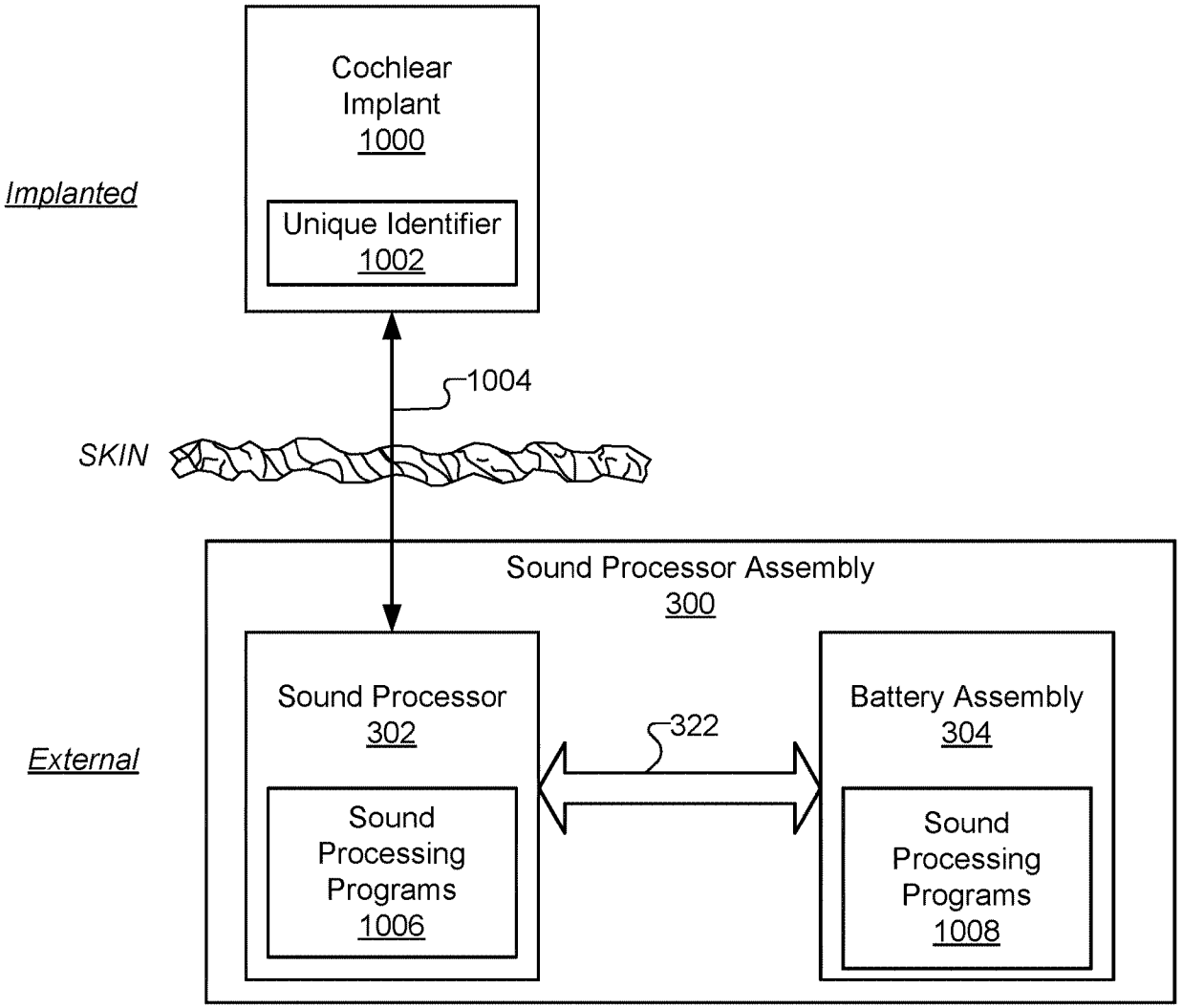
FIG. 10 illustrates an exemplary configuration in which the sound processor assembly of FIG. 3 and an exemplary cochlear implant interoperate to facilitate synchronization of cochlear implant sound processing programs according to principles described herein.

FIG. 10 illustrates an exemplary configuration in which sound processor assembly 300 (described above in relation to FIG. 3) and an exemplary cochlear implant 1000 interoperate to facilitate a synchronization transfer (e.g., a sound processor-initiated synchronization transfer) of cochlear implant sound processing programs. Specifically, as shown, cochlear implant 1000 may be associated with (e.g., may be assigned, may correspond to, etc.) a unique identifier 1002 and may be implanted within a patient (i.e., located on the "implanted" side of the skin of the patient). Unique identifier 1002 may be a number (e.g., a serial number) or other identifier permanently associated with cochlear implant 1000. For example, wire bonding techniques may be used to encode a binary number on cochlear implant 1000 that uniquely distinguishes cochlear implant 1000 from all other cochlear implants such that cochlear implant 1000 may be uniquely identified.

As further shown in FIG. 10, cochlear implant 1000 may be communicatively coupled via a transcutaneous link 1004 with sound processor assembly 300. For example, as described above in relation communication link 114 in FIG. 1, transcutaneous link 1004 may enable sound processor assembly 300 to wirelessly transmit stimulation parameters and/or power signals to cochlear implant 1000 by way of transcutaneous link 1004. In some examples, transcutaneous link 1004 may include a bidirectional communication link and/or one or more dedicated unidirectional communication links. It will be understood that transcutaneous link 1004 may involve one or more additional components not explicitly shown in FIG. 10. For example, a headpiece such as headpiece 106 of FIG. 1 may be used to implement transcutaneous link 1004.

Sound processor 302 within sound processor assembly 300 may include one or more sound processing programs 1006, or, may not include any sound processing programs 1006 (e.g., if sound processor 302 is a new replacement sound processor that has not yet been programmed). Sound processing programs 1006 may be similar or the same as sound processing programs 402, described above. Sound processor 302 may be communicatively coupled with battery assembly 304 by way of active communication link 322. For example, as described above, communication link 322 may include a wired or wireless link (e.g., a serial wired interface such as a 1-wire or an $I^2C$ interface or the like, a parallel wired interface, etc.) by which sound processor 302 may intercommunicate with battery assembly 304. As shown, sound processor 302 may be located external to the skin of the patient (i.e., on the other side of the skin from cochlear implant 1000).

Similarly, battery assembly 304 may include one or more sound processing programs 1008, or, in certain examples, may not include any sound processing programs 1008 (e.g., if battery assembly 304 is a new battery assembly that has not yet received any sound processing programs during a synchronization transfer). Sound processing programs 1008 may be similar or the same as sound processing programs 402, described above. Battery assembly 304 may be communicatively coupled with sound processor 302 by way of active communication link 322. Battery assembly 304 may be located externally to the patient within sound processor assembly 300, as shown.

As described above, each sound processing program (e.g., sound processing programs 1006, sound processing programs 1008, etc.) may be associated with a particular cochlear implant. In other words, each sound processing program may be customized according to particular characteristics (e.g., preferences, etc.) of the patient and/or the cochlea with which the cochlear implant is associated. For example, one of sound processing programs 1006 may be customized (i.e., specially configured) for cochlear implant 1000 based on the unique characteristics of the patient within whom cochlear implant 1000 is implanted.

As such, sound processor 302 may facilitate sound processor-initiated synchronization of a sound processing program by performing (e.g., in any suitable order) operations including, but not limited to, the following operations. First, sound processor 302 may detect an availability of an active communication link (e.g., communication link 322) between sound processor 302 and battery assembly 304 by way of the bidirectional communication interface included within sound processor 302. Second, sound processor 302 may determine (e.g., by way of communication with battery assembly 304 over communication link 322) that the sound processing program is included on only one of sound processor 302 and battery assembly 304 (e.g., only one of storage facility 314 within sound processor 302 and storage facility 320 within battery assembly 304). Third, in response to this determination, sound processor 302 may initiate a synchronization transfer of the sound processing program by way of communication link 322 to cause the sound processing program to be included within the respective storage facilities of both sound processor 302 and battery assembly 304.

In some examples, sound processor 302 may further facilitate sound processor-initiated synchronization of the sound processing program by performing one or more additional operations in any order as may serve a particular implementation. For example, sound processor 304 may detect unique identifier 1002 of cochlear implant 1000, determine (e.g., based on unique identifier 1002 and as part of the identification of the sound processing program that is included on only one of sound processor 302 and battery assembly 304) that the sound processing program is associated with cochlear implant 1000, and direct cochlear implant 1000 to stimulate the patient in accordance with the sound processing program based on the determination. In other words, prior to directing cochlear implant 1000 to stimulate the patient in accordance with any sound processing program 1006, sound processor 302 may verify that a particular sound processing program to be used is associated with cochlear implant 1000, rather than with another cochlear implant. If, for example, a particular sound processing program 1006 is not associated with cochlear implant 1000, sound processor 302 may use a different sound processing program 1006 for directing cochlear implant 1000 to stimulate the patient. Similarly, if no sound processing program 1006 is available that is associated with cochlear implant 1000, sound processor 302 may be configured to perform sound processor-initiated synchronization of sound processing programs with battery assembly 304 to attempt to access a sound processing program that is associated with cochlear implant 1000.

Sound processor-initiated synchronization of cochlear implant sound processing programs may be performed in any way as may serve a particular implementation. For example, in various implementations, sound processing programs may be synchronized, updated, backed up, and/or otherwise transferred within sound processor assembly 300 (e.g., between sound processor 302 and battery assembly 304) using manual or automatic operations.

For example, using controls included on sound processor 300 (e.g., an extended button press, etc.) and/or controls that may be included on battery assembly 304 (e.g., a user-manipulable interface including one or more buttons, LEDs, or the like), a patient or other user may manually initiate synchronization transfers and/or otherwise manage and direct how sound processing programs are transferred between sound processor 302 and battery assembly 304 and/or which sound processing programs are transferred. Specifically, the identification of the sound processing program that is included on only one of sound processor 302 and battery assembly 304 may be performed by receiving user input (e.g., by way of a user interface on sound processor 302 or battery assembly 304, etc.) indicative of the sound processing program, and the initiation of the synchronization transfer of the identified sound processing program may be performed based on the user input.

Additionally or alternatively, sound processor 302 and battery assembly 304 may be configured to automatically perform sound processor-initiated synchronization of sound processing programs. For example, synchronization transfers may be performed automatically as part of a boot process of sound processor assembly 300 prior to sound processor assembly 300 entering normal stimulation mode, or at any other time as may serve a particular implementation.

Synchronization of sound processing programs may be "sound processor-initiated" regardless of whether the operations are instigated manually (e.g., by a patient connecting battery assembly 304 to sound processor 302 or directing the synchronization by way of, for example, a button press on sound processor assembly 300) or automatically. Put another way, sound processor-initiated synchronization may involve synchronization operations (e.g., programming operations, operations to initiate synchronization transfers, etc.) that may be performed between sound processor 302 and battery assembly 304 without involvement of other systems controlled or operated by third parties such as clinicians, sound processor manufacturers, and the like.

FIGS. 11 through 14 illustrate various exemplary synchronization transfers in which sound processor 302 and battery assembly 304 of sound processor assembly 300 facilitate automatic sound processor-initiated synchronization of cochlear implant sound processing programs.

Figure 11:
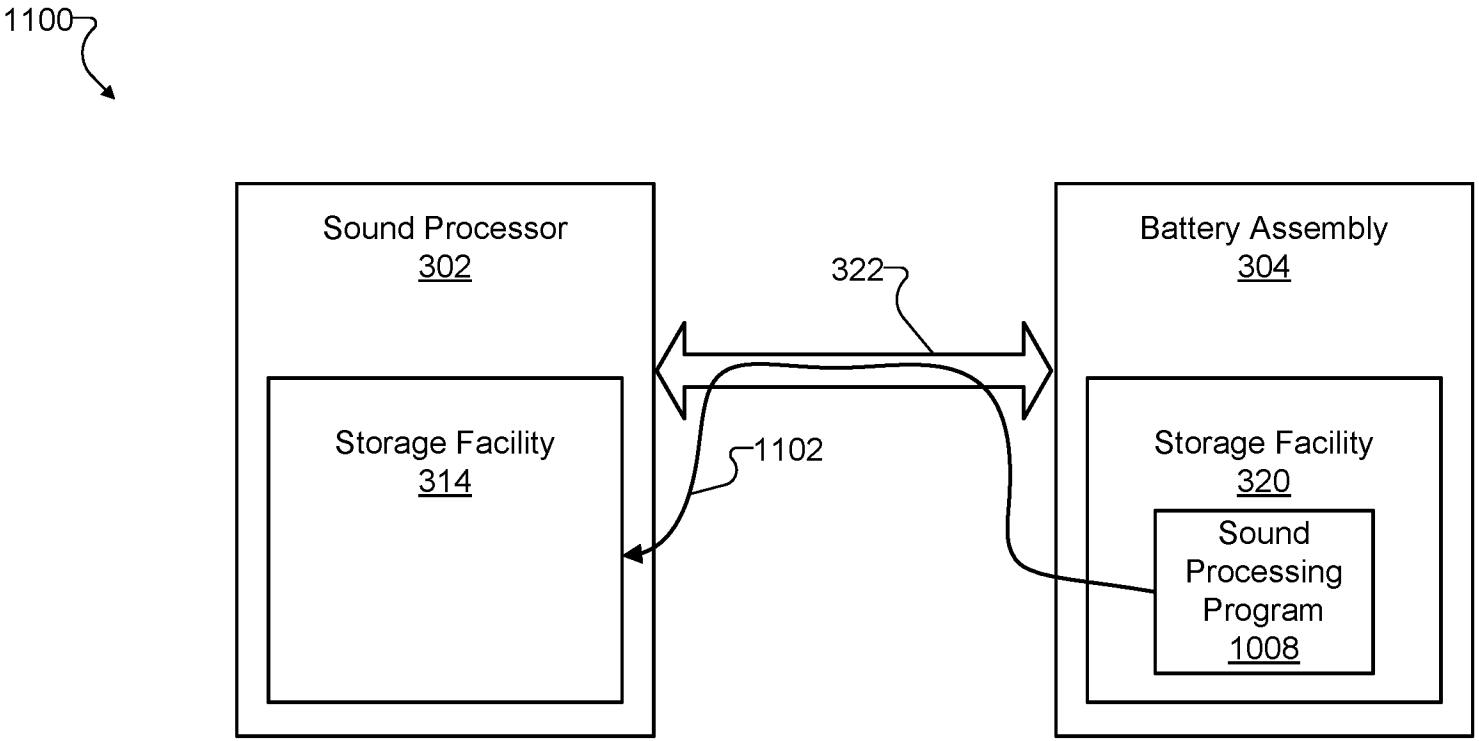
FIGS. 11 through 14 illustrate various exemplary synchronization transfers in which the sound processor and battery assembly of the sound processor assembly of FIG. 3 facilitate automatic synchronization of cochlear implant sound processing programs according to principles described herein.

Specifically, FIG. 11 illustrates a synchronization transfer 1100 in which storage facility 314 of sound processor 302 does not include any sound processing programs 1006. For example, synchronization transfer 1100 may be used in a scenario where sound processor 302 is a new replacement sound processor that has not yet been programmed and needs to recover one or more sound processing programs that were previously stored to (e.g., backed up on) battery assembly 304 by a sound processor that was previously lost, destroyed, or otherwise rendered unusable.

In FIG. 11, sound processor 302 automatically initiates synchronization transfer 1100 of a particular sound processing program 1008 (e.g., representing any of sound processing programs 402 illustrated in FIG. 4) from battery assembly 304. Specifically, sound processor 302 may automatically determine that sound processing program 1008 is included on battery assembly 304 (e.g., within storage facility 320) and not on sound processor 302 (e.g., within storage facility 314), and, in response to this automatic determination, may download sound processing program 1008 from battery assembly 304 by way of active communication link 322. As shown, an arrow 1102 indicates that sound processing program 1008 is downloaded (e.g., copied over) from storage facility 320 of battery assembly 304 to storage facility 314 of sound processor 302 by way of active communication link 322.

In certain examples, sound processor 302 may detect a unique identifier of a cochlear implant included within the cochlear implant system (e.g., unique identifier 1002 of cochlear implant 1000, not explicitly shown in FIG. 11), and the initiation of synchronization transfer 1100 may be performed by automatically determining that sound processor 302 does not include any sound processing program 1006 associated with the particular cochlear implant (e.g., cochlear implant 1000). Moreover, sound processor 302 may also, as part of the downloading, transmit to battery assembly 304 (e.g., by way of active communication link 322 and in response to the automatic determination that sound processor 302 does not include any sound processing program associated with the cochlear implant) data representative of a request for battery assembly 304 to transmit sound processing program 1008 to sound processor 302 by way of active communication link 322, and receive sound processing program 1008 from battery assembly 304.

In other words, for example, upon connecting to a cochlear implant such as cochlear implant 1000 illustrated in FIG. 10, sound processor 302 may determine the identity of the cochlear implant 1000, determine that sound processor 302 does not have a sound processing program associated with cochlear implant 1000, automatically send a request to battery assembly 304 for a sound processing program that is associated with cochlear implant 1000, and, upon downloading such a sound processing program (e.g., sound processing program 1008 and/or one or more other sound processing programs associated with cochlear implant 1000), proceed to direct cochlear implant 1000 to stimulate the patient in accordance with the downloaded sound processing program.

Figure 12:
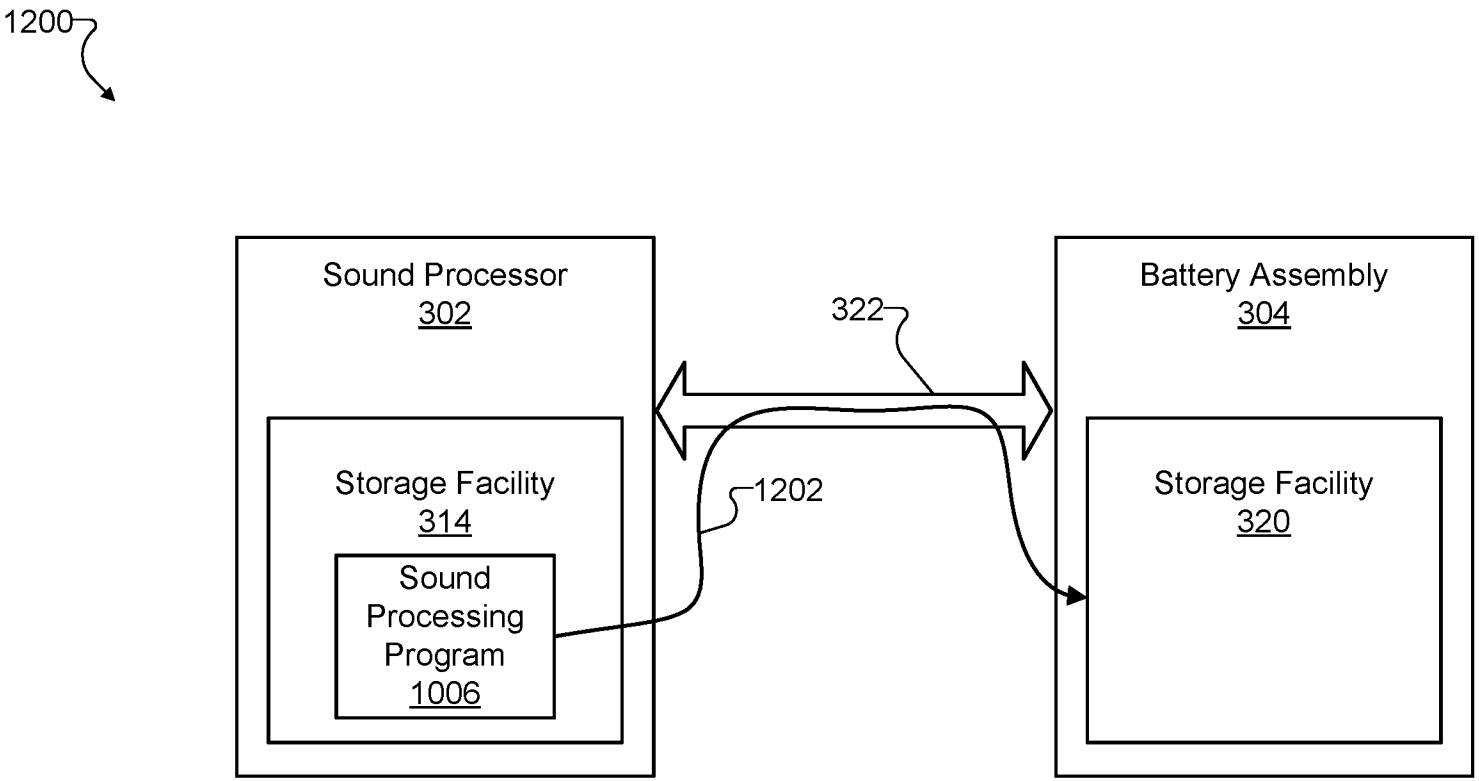

FIG. 12 shows a synchronization transfer 1200, which is similar to synchronization transfer 1100 except that, in synchronization transfer 1200, it is storage facility 320 of battery assembly 304 that does not include any sound processing programs 1008. For example, synchronization transfer 1200 may be used for a scenario where sound processor 302 is a programmed sound processor (i.e., not a new replacement) and battery assembly 304 is a new battery assembly or battery assembly 304 has not yet received a particular new sound processing program 1006 that may have recently been loaded onto sound processor 302 (e.g., by a clinician at a clinical visit).

In FIG. 12, sound processor 302 automatically initiates synchronization transfer 1200 of sound processing program 1006 (e.g., representing any particular sound processing program that may be stored within storage facility 314) to battery assembly 304. Specifically, sound processor 302 may automatically determine that sound processing program 1006 is included on sound processor 302 (e.g., within storage facility 314) and not on battery assembly 304 (e.g., within storage facility 320), and, in response to this automatic determination, may upload sound processing program 1006 to battery assembly 304 by way of active communication link 322. As shown, an arrow 1202 indicates that sound processing program 1006 is uploaded (e.g., copied over) from storage facility 314 of sound processor 302 to storage facility 320 of battery assembly 304 by way of active communication link 322.

As described above with respect to FIG. 11, in certain examples, sound processor 302 may also detect a unique identifier of a cochlear implant included within the cochlear implant system (e.g., unique identifier 1002 of cochlear implant 1000, not explicitly shown in FIG. 12), and the initiation of synchronization transfer 1200 may be performed by automatically determining that battery assembly 304 does not include any sound processing program 1008 associated with the particular cochlear implant (e.g., cochlear implant 1000). As such, the uploading of sound processing program 1006 to battery assembly 304 may be performed in response to the automatic determination that battery assembly 304 does not include any sound processing program associated with the cochlear implant.

In other words, for example, upon connecting to a cochlear implant such as cochlear implant 1000 illustrated in FIG. 10, sound processor 302 may determine the identity of the cochlear implant 1000, determine that sound processor 302 has a sound processing program associated with cochlear implant 1000 (e.g., sound processing program 1006), determine that sound processing program 1006 has not been backed up onto battery assembly 304, and, in response to the determination that sound processing program 1006 has not been backed up, upload sound processing program 1006 to battery assembly 304. In other examples, the synchronization transfer may occur at different times (e.g., a time other than at startup of the cochlear implant) and/or in any manner as may serve a particular implementation.

Figure 13:
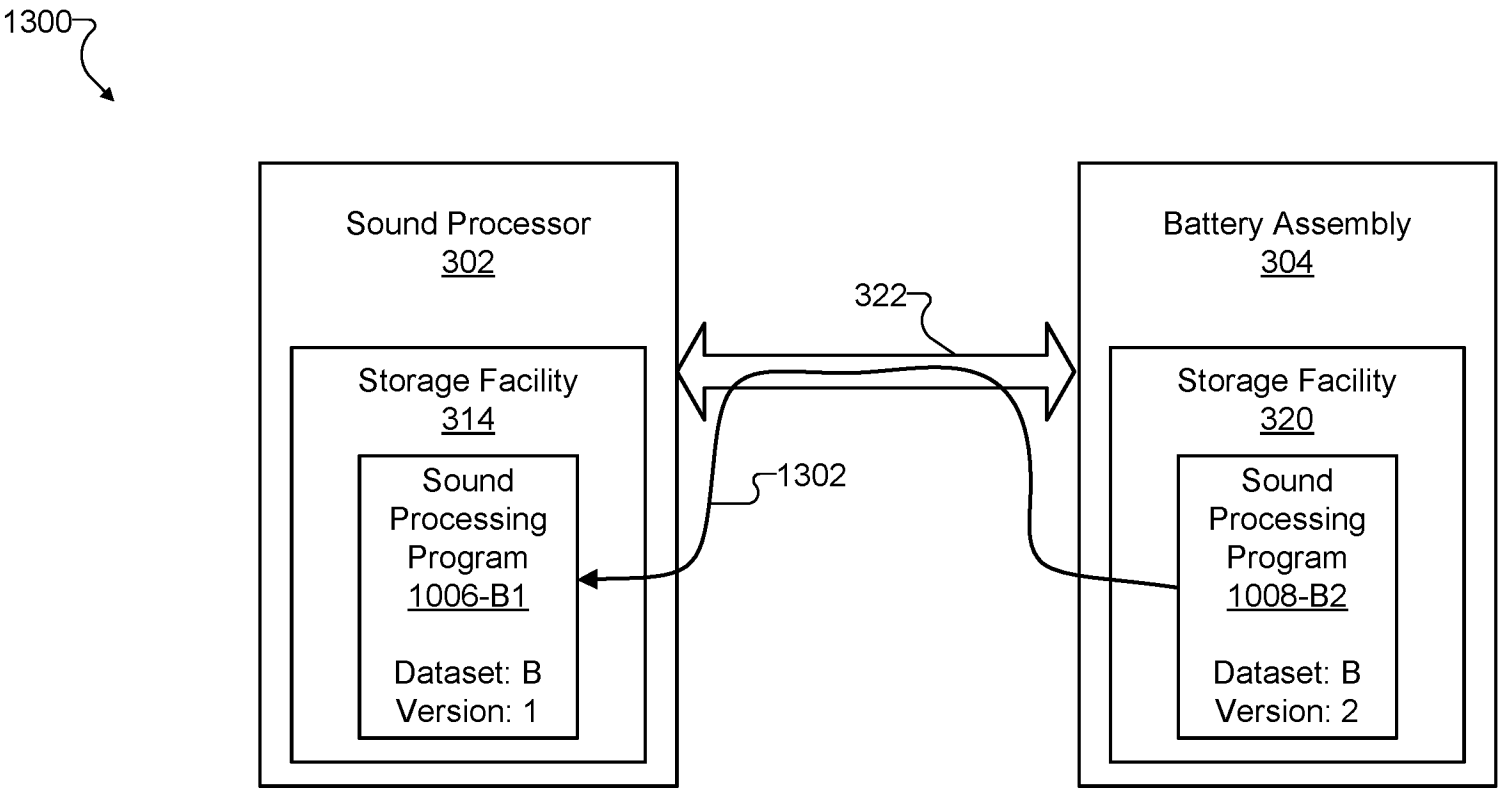

FIG. 13 illustrates a synchronization transfer 1300 in which storage facility 314 of sound processor 302 includes a sound processing program 1006-B1 and storage facility 320 of battery assembly 304 includes a sound processing program 1008-B2. As shown by annotations in FIG. 13, both sound processing programs 1006-B1 and 1008-B2 may represent a same sound processing program (e.g., associated with a same cochlear implant) referred to in FIG. 13 as sound processing program 'B'. However, as further illustrated in FIG. 13, sound processing program 1006-B1 may represent one version of sound processing program 'B' (i.e., version '1') while sound processing program 1008-B2 may represent a different version of sound processing program 'B' (i.e., version '2'). For example, synchronization transfer 1300 may be used for a scenario where sound processor 302 includes a non-preferred version of a particular sound processing program associated with a particular cochlear implant (e.g., an old or out-of-date version, a version with a known issue, a version that lacks one or more desirable features and/or that includes one or more undesirable features, a version not selected or preferred by the patient, etc.) and battery assembly 304 includes a preferred version of the particular sound processing program associated with the particular cochlear implant (e.g., a new or up-to-date version, a version in which a previous issue has been resolved, a version that includes one or more desirable features and/or that lacks one or more undesirable features, a version selected or preferred by the patient, etc.). Accordingly, it may be desirable, in the context of synchronization transfer 1300, for the non-preferred version of sound processing program 'B' (i.e., sound processing program 1006-B1) to be updated to the preferred version (i.e., sound processing program 1008-B2).

To this end, as shown in FIG. 13, sound processor 302 may automatically initiate synchronization transfer 1300 of sound processing program 1008-B2 from battery assembly 304. Specifically, sound processor 302 may automatically determine that the non-preferred version of the sound processing program associated with the particular cochlear implant (i.e., sound processing program 1006-B1) is included on sound processor 302 (e.g., within storage facility 314), and, may download the preferred version of the sound processing program (i.e., sound processing program 1008-B2) from battery assembly 304. For example, sound processor assembly 300 may download the preferred version by receiving data representative of sound processing program 1008-B2 from battery assembly 304 by way of active communication link 322, and, based on the received data representative of sound processing program 1008-B2, replacing sound processing program 1006-B1 with sound processing program 1008-B2. As shown, an arrow 1302 indicates that sound processing program 1008-B2 from storage facility 320 of battery assembly 304 is used to update sound processing program 1006-B1 within storage facility 314 of sound processor 302 by way of active communication link 322.

The data representative of sound processing program 1008-B2 may be any suitable data and sound processor 302 may replace sound processing program 1006-B1 with sound processing program 1008-B2 based on the data in any manner as may serve a particular implementation. For instance, in certain examples, the data representative of sound processing program 1008-B2 may include all the data of sound processing program 1008-B2 and the replacing may include deleting sound processing program 1006-B1 and storing, in its place, sound processing program 1008-B2. As another example, the data representative of sound processing program 1008-B2 may include only revised portions of sound processing program 1008-B2 and/or instructions for updating sound processing program 1006-B1 to include the revised portions.

Figure 14:
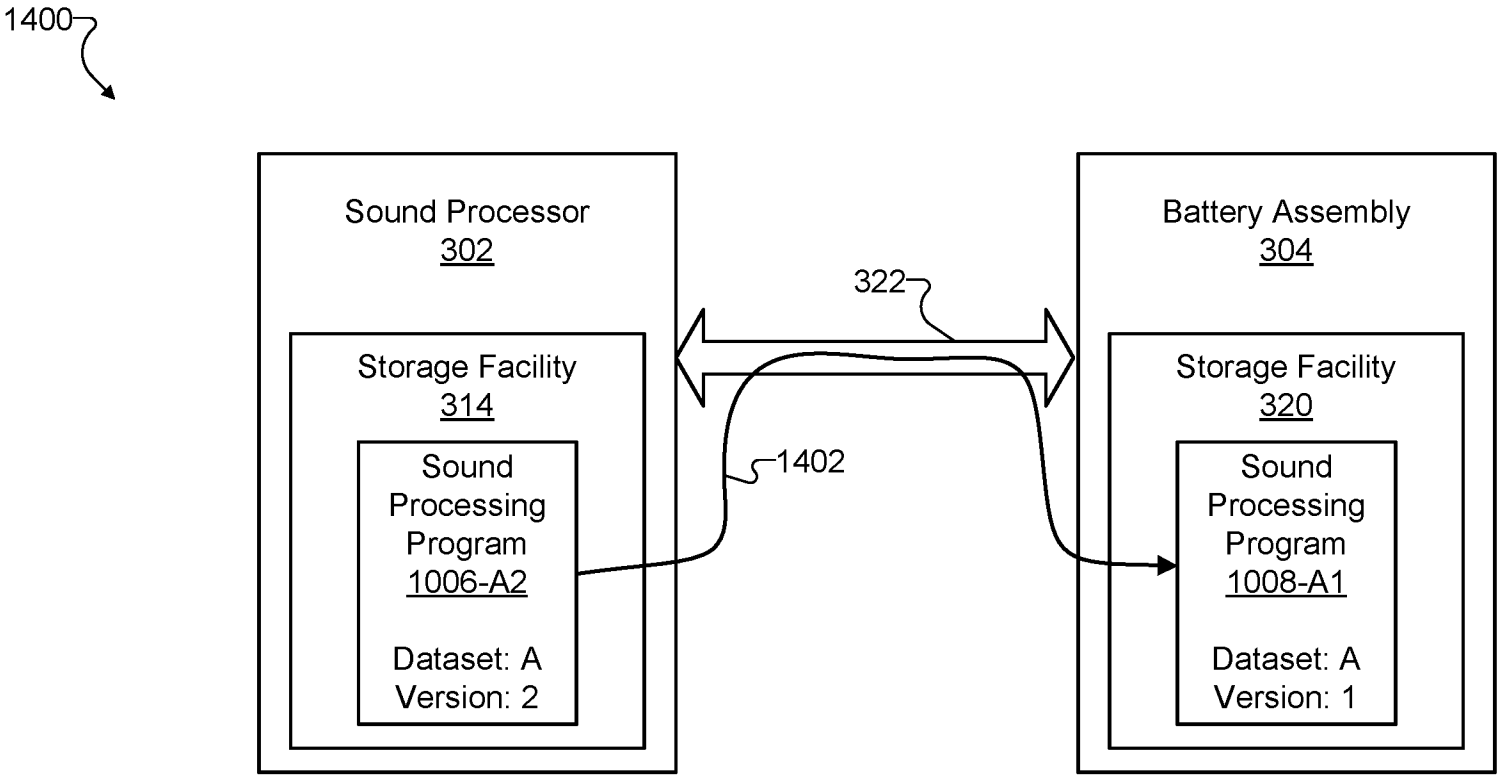

FIG. 14 shows a synchronization transfer 1400 in which storage facility 314 of sound processor 302 includes a sound processing program 1006-A2 and storage facility 320 of battery assembly 304 includes a sound processing program 1008-A1. As shown by annotations in FIG. 14, both sound processing programs 1006-A2 and 1008-A1 may represent a same sound processing program (e.g., associated with a same cochlear implant) referred to in FIG. 14 as sound processing program 'A'. However, as further illustrated in FIG. 14, sound processing program 1006-A2 may represent one version of sound processing program 'A' (i.e., version '2') while sound processing program 1008-A1 may represent a different version of sound processing program 'A' (i.e., version '1'). For example, similar to synchronization transfer 1300 of FIG. 13, synchronization transfer 1400 may be used for a scenario where sound processor 302 includes a preferred version of a particular sound processing program associated with a particular cochlear implant and battery assembly 304 includes a non-preferred version of the particular sound processing program associated with the particular cochlear implant. Accordingly, it may be desirable, in the context of synchronization transfer 1400, for the non-preferred version of sound processing program 'A' (i.e., sound processing program 1008-A1) to be updated to the preferred version (i.e., sound processing program 1006-A2).

To this end, as shown in FIG. 14, sound processor 302 may automatically initiate synchronization transfer 1400 of sound processing program 1006-A2 to battery assembly 304. Specifically, sound processor 302 may automatically determine that the non-preferred version of the sound processing program associated with the particular cochlear implant (i.e., sound processing program 1008-A1) is included on battery assembly 304 (e.g., within storage facility 320), and, may upload the preferred version of the sound processing program (i.e., sound processing program 1006-A2) to battery assembly 304. For example, sound processor 302 may upload the preferred version by transmitting data representative of sound processing program 1006-A2 and of a command for battery assembly 304 to replace sound processing program 1008-A1 with sound processing program 1006-A2 to battery assembly 304 by way of active communication link 322. As shown, an arrow 1402 indicates that sound processing program 1006-A2 from storage facility 314 of sound processor 302 is used to update sound processing program 1008-A1 within storage facility 320 of battery assembly 304 by way of active communication link 322.

The data representative of sound processing program 1006-A2 and the command for battery assembly 304 to replace sound processing program 1008-A1 with sound processing program 1006-A2 may each include any suitable data as may serve a particular implementation. For instance, in certain examples, the data representative of sound processing program 1006-A2 may include all the data of sound processing program 1006-A2 and the command may instruct battery assembly 304 to delete sound processing program 1008-A1 and store, in its place, sound processing program 1006-A2. As another example, the data representative of sound processing program 1006-A2 may include only revised portions of sound processing program 1006-A2 and the command may instruct battery assembly 304 to replace portions of sound processing program 1008-A1 with the revised portions.

As described above, FIGS. 10 through 14 illustrate various types of synchronization transfers between sound processor 302 and battery assembly 304 within sound processor assembly 300 to provide convenience to the patient and other benefits (e.g., benefits associated with procurement flow 900 and/or other benefits described herein). In addition to or as an alternative to synchronization transfers between a sound processor and a battery assembly, systems and methods described herein may further support remote loading of sound processing programs unto a sound processor assembly to provide the same, similar, and/or additional benefits as those described above in relation to the synchronization transfers.

As used herein, the "remote loading" of a sound processing program may refer to any of various aspects of the transfer, receipt, storage, selection, and/or use of a sound processing program on a sound processor that does not initially have local access to the sound processing program, but, as a result of the remote loading, is able to access a copy of the sound processing program from a remote computing system (e.g., by way of a network). For example, when a sound processor does not have local access to the sound processing program, certain types of synchronization transfers described above may not be able to provide the sound processing program to the sound processor (e.g., because the sound processing program is not available on either the sound processor or the battery assembly). As such, it may be necessary for the sound processor to access the sound processing program from a remote computing system that does have the sound processing program available.

A remote computing system located remotely from a cochlear implant system may be any computing system (e.g., cloud server, etc.) that is communicatively coupled to the cochlear implant system (e.g., the sound processor of the cochlear implant system) by way of a network (e.g., including the Internet and/or one or more subnetworks). In some examples, for instance, the remote computing system may be located a long distance away from the cochlear implant system (e.g., in a different country, a different state, a different city, etc.). In other examples, the remote computing system may merely be located in a different building than the cochlear implant system (or a different room of the same building) such that the active network link may be used for the remote computing system and cochlear implant system to communicate.

As such, the remote loading of a sound processing program from a remote computing system to a sound processor assembly of a cochlear implant system may include transferring the sound processing program from a remote storage facility on the remote computing system's side of the active network link to a local storage facility on the cochlear implant system's side of the active network link (e.g., a storage facility included in the sound processor or in a battery assembly within the sound processor assembly), as will be described in more detail below. In some examples, the remote loading of the sound processing program may additionally refer to the storage of the sound processing program, the selecting and switching (e.g., loading up) of the sound processing program onto the sound processor as the active sound processing program, and/or the use of the sound processing program by the sound processor to process incoming audio signals for the patient.

In some examples, sound processor assembly 300 may interoperate with a remote computing system to remotely load a sound processing program onto sound processor assembly 300 (e.g., onto the storage facility of sound processor 302 and/or onto the storage facility of battery assembly 304) from the remote computing system. To illustrate, FIG. 15 illustrates an exemplary configuration 1500 in which sound processor assembly 300 interoperates with a remote computing system 1502 to remotely load a sound processing program onto sound processor assembly 300 while sound processor assembly 300 is located remotely from remote computing system 1502.

Specifically, as shown in configuration 1500, remote computing system 1502 includes a remote storage facility 1504 and a connection 1506 to a network 1508 that facilitates communication between remote computing system 1502 and sound processor 302 of sound processor assembly 300, which is coupled to network 1508 by a connection 1510. A patient 1512 may be associated with (e.g., may use and be located in a same location as) sound processor assembly 300, which may be included, along with cochlear implant 1000 and other system components not explicitly shown, within a comprehensive cochlear implant system associated with patient 1512 (e.g., such as cochlear implant system 100). As shown, while cochlear implant 1000 is enlarged to show detail, cochlear implant 1000 may be implanted within patient 1512, while sound processor 302 and battery assembly 304 may be located externally to patient 1512 (e.g., worn behind the ear of patient 1512, etc.). Within cochlear implant 1000, unique ID 1002 may be stored or otherwise programmed or included such that sound processor 302 may detect it to identify cochlear implant 1000. As described above, unique ID 1002 may include a serial number and/or any other unique dataset that identifies cochlear implant 1000 as may serve a particular implementation.

Figure 15:
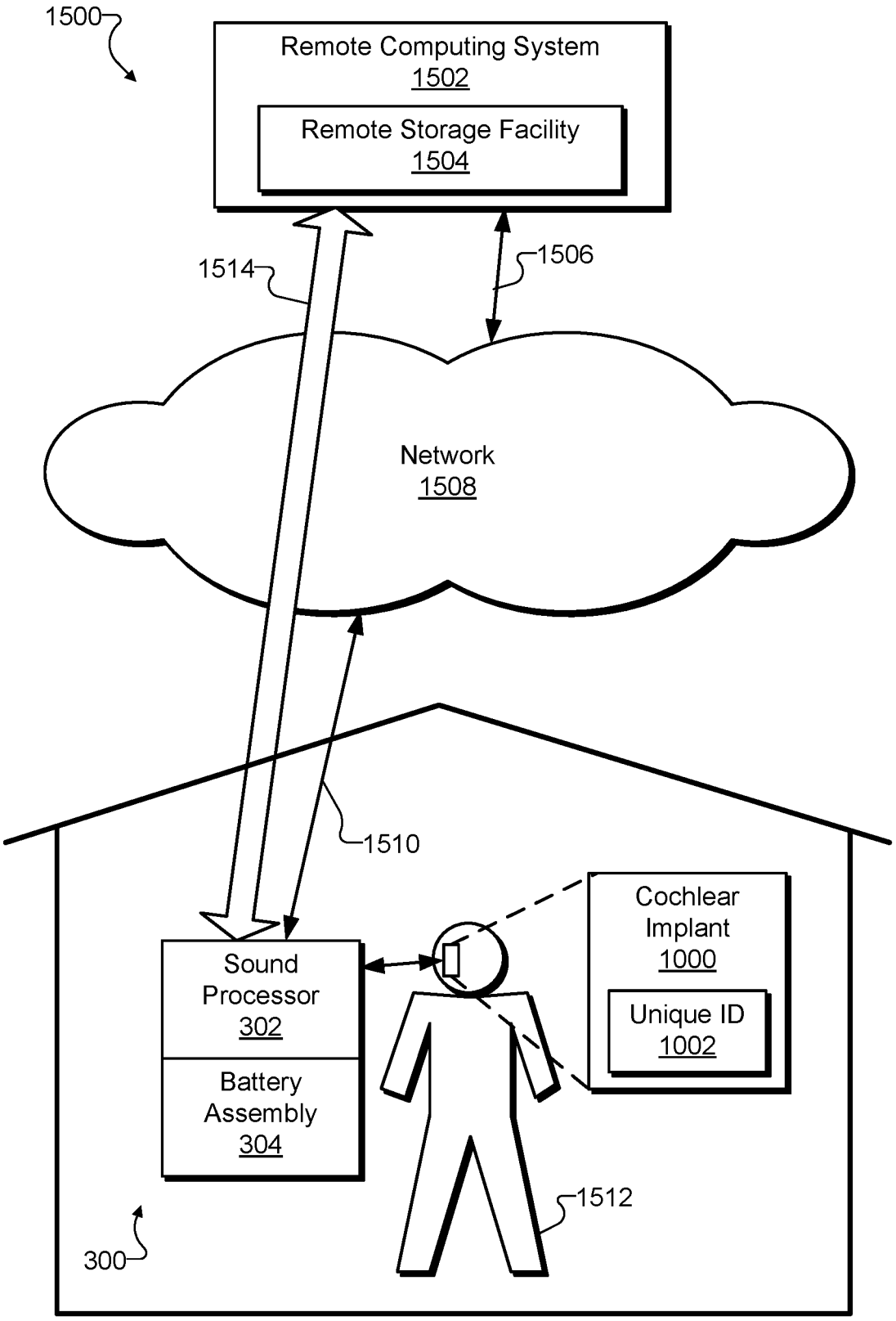
FIG. 15 illustrates an exemplary configuration in which the sound processor assembly of FIG. 3 interoperates with a remote computing system to remotely load a sound processing program onto the sound processor assembly according to principles described herein.

Patient 1512 and the components of the cochlear implant system illustrated in FIG. 15 may be located remotely from remote computing system 1502. For example, as shown, patient 1512 and the cochlear implant system may be located at the home of patient 1512, while remote computing system 1502 may be implemented as a cloud server located elsewhere and accessed only by way of network 1508.

To this end, network 1508 may include any provider-specific network (e.g., a cable, satellite, or mobile phone carrier network, or the like), the Internet, any wide area network, or any other suitable network, and data may flow between sound processor 302 and remote computing system 1502 by way of network 1508 using any suitable communication technologies, devices, media, and protocols as may serve a particular implementation. While only one network 1508 is shown to interconnect sound processor 302 and remote computing system 1502 in configuration 1500, it will be recognized that network 1508 may represent various interconnected networks and/or subnetworks, and that devices and systems connected to network 1508 may communicate with one another by way of multiple interconnected networks as may serve a particular implementation.

FIG. 15 illustrates how sound processor 302 and remote computing system 1502 may interoperate to remotely load (e.g., from remote computing system 1502) a sound processing program onto sound processor assembly 300 (e.g., onto sound processor 302, onto battery assembly 304, or onto both) in the cochlear implant system associated with patient 1512. For example, as shown, sound processor 302 and remote computing system 1502 may establish an active network link 1514 by way of network 1508. As used herein, both sound processor 302 and remote computing system 1502 may be said to have "established" active network link 1514 when communications between sound processor 302 and remote computing system 1502 begin, regardless of whether sound processor 302 or remote computing system 1502 initiated the first communication. Thus, for example, sound processor 302 and remote computing system 1502 may each establish active network link 1514 either by requesting the other system to initiate active network link 1514, or by initiating active network link 1514 in response to a request from the other system.

In order to establish active network link 1514, both sound processor 302 and remote computing system 1502 may be communicatively coupled, by way of connections 1510 and 1506, respectively, with network 1508. Connections 1510 and 1506 may be implemented by any suitable connections as may serve a particular implementation. For example, connection 1510, by way of which sound processor 302 may be communicatively coupled to network 1508, may be implemented by, for instance, a wireless connection (e.g., a BLUETOOTH connection, an 802.11 (Wi-Fi) connection, a proprietary wireless connection, etc.), a wired connection (e.g., an Ethernet connection, etc.), by way of another device (e.g., a mobile device, a personal computer, a router, etc.), or by any other type of connection as may serve a particular implementation. Similarly, connection 1506, by way of which remote computing system 1502 may be communicatively coupled to network 1508, may be implemented by similar wireless or wired connections and protocols.

Prior or subsequent to the establishment of active network link 1514, sound processor 302 may detect unique ID 1002 of cochlear implant 1000 implanted within patient 1512. This detection may be performed in any suitable way. For example, in certain implementations, sound processor 302 may query (e.g., send a request and receive data in response to the request) cochlear implant 1000 at a startup time or another suitable time (e.g., by way of a headpiece not explicitly shown in FIG. 15). In other examples, sound processor 302 may store unique ID 1002 (e.g., within storage facility 314 of sound processor 302 or within storage facility 314 of battery assembly 304) and detect unique ID 1002 by accessing unique ID 1002 where it is stored, rather than by querying cochlear implant 1000.

Once unique ID 1002 is detected, sound processor 302 may transmit unique ID 1002 to remote computing system 1502 over active network link 1514. In some examples, sound processor 302 may further transmit to remote computing system 1502 (i.e., together with unique ID 1002) a sound processing program download request identifying a sound processing program that sound processor 302 is requesting to receive (e.g., a particular sound processing program associated with cochlear implant 1000). The sound processing program download request may take any form as may serve a particular implementation. For example, the sound processing program download request may include a filename, filepath, or other identifying information for the particular sound processing program being requested. In some examples, the sound processing program download request may be a request for permission to access a particular folder or other similar structure within remote storage facility 1504 of remote computing system 1502 that is associated with (e.g., that contains) sound processing programs associated with cochlear implant 1000, with patient 1512, or the like.

As a result of the transmission by sound processor 302, remote computing system 1502 may receive unique ID 1002 and/or the sound processing program download request from sound processor 302 over active network link 1514. In response to the receipt of unique ID 1002, remote computing system 1502 may validate unique ID 1002 to ensure that unique ID 1002 is valid and that a repository of sound processing programs included within remote storage facility 1504 includes at least one sound processing program associated with the cochlear implant. In response to the validation of unique ID 1002 and based on unique ID 1002, remote computing system 1502 may identify a sound processing program associated with cochlear implant 1000 and that is included in the repository of sound processing programs. For example, if sound processor 302 transmits a sound processing program download request identifying a requested sound processing program that is associated with cochlear implant 1000, remote computing system 1502 may identify the sound processing program based on the sound processing program download request (e.g., by identifying the requested sound processing program from the repository of sound processing programs).

In response to the identification of the sound processing program associated with cochlear implant 1000, remote computing system 1502 may transmit data representative of the identified sound processing program to sound processor 302 over active network link 1514 and sound processor 302 may receive the data representative of the sound processing program. In examples where a sound processing program download request was transmitted, sound processor 302 may receive the data representative of the sound processing program in response to the transmission of the sound processing program download request. In response to receiving the data representative of the sound processing program, sound processor 302 may verify, scan, and/or otherwise check or analyze the data to ensure that the data is complete, secure, correct, and represents the expected sound processing program. Assuming such verification reveals that the correct sound processing program has been received without issue, sound processor 302 may store the received data representative of the sound processing program on battery assembly 304 (e.g., within storage facility 320 of battery assembly 304).

In some examples, sound processor 302 may store the data representative of the sound processing program on battery assembly 304 automatically (e.g., in the background without necessarily bringing the new storage to the attention of patient 1512). In other examples, sound processor 302 may store the data representative of the sound processing program on battery assembly 304 only after notifying patient 1512 and/or requesting and receiving approval from patient 1512. This may be performed in any suitable way and may involve use of one or more user interfaces of sound processor assembly 300 or of a device associated with sound processor 302.

As described above, after the sound processing program has been stored in battery assembly 304, sound processor 302 may activate the sound processing program by accessing the sound processing program from battery assembly 304 (e.g., by loading up the sound processing program into a memory of sound processor 302), and directing cochlear implant 1000 to stimulate patient 1512 in accordance with the sound processing program.

Figure 16:
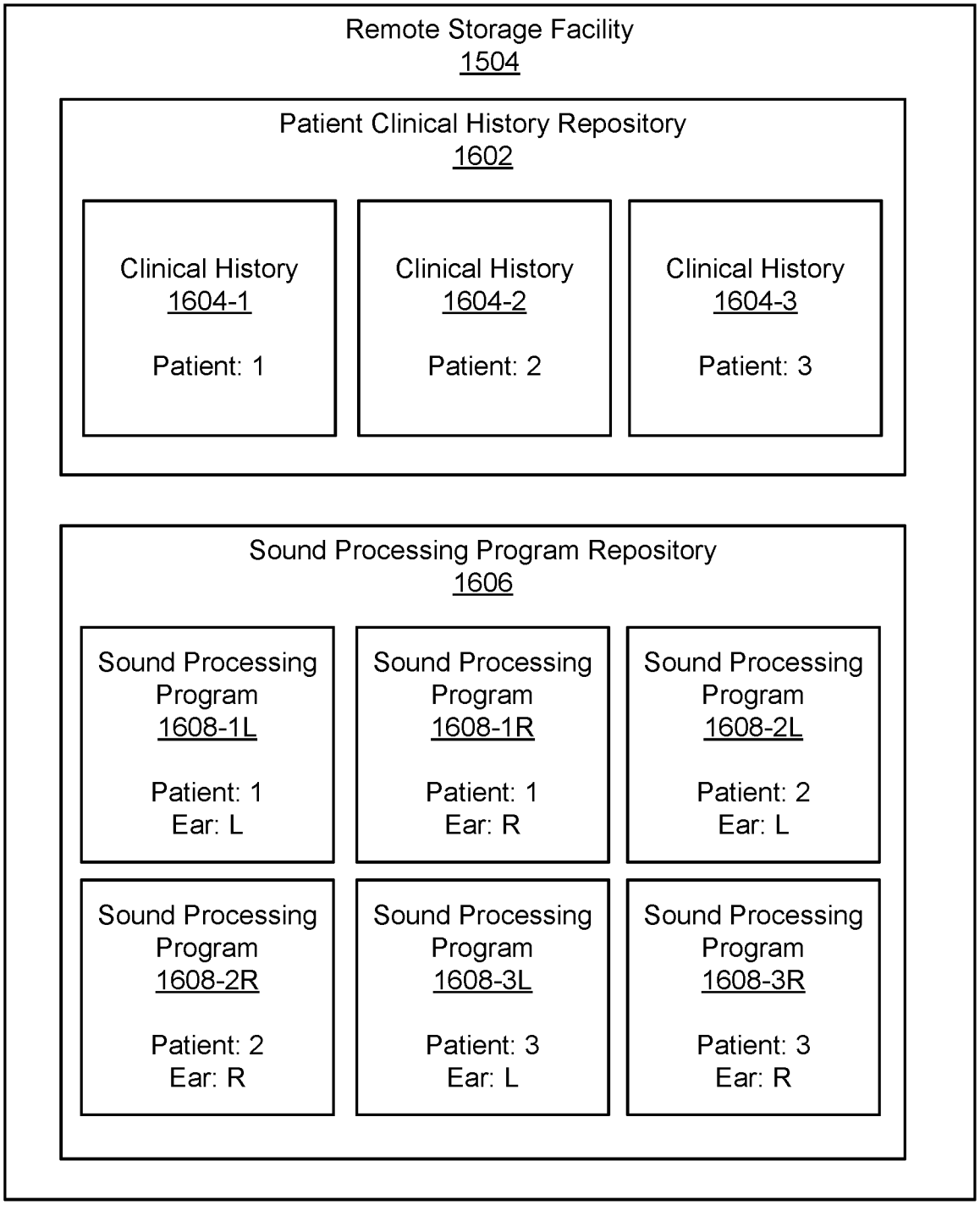
FIG. 16 illustrates exemplary components of the remote storage facility of the remote computing system of FIG. 15 according to principles described herein.
Figure 17:
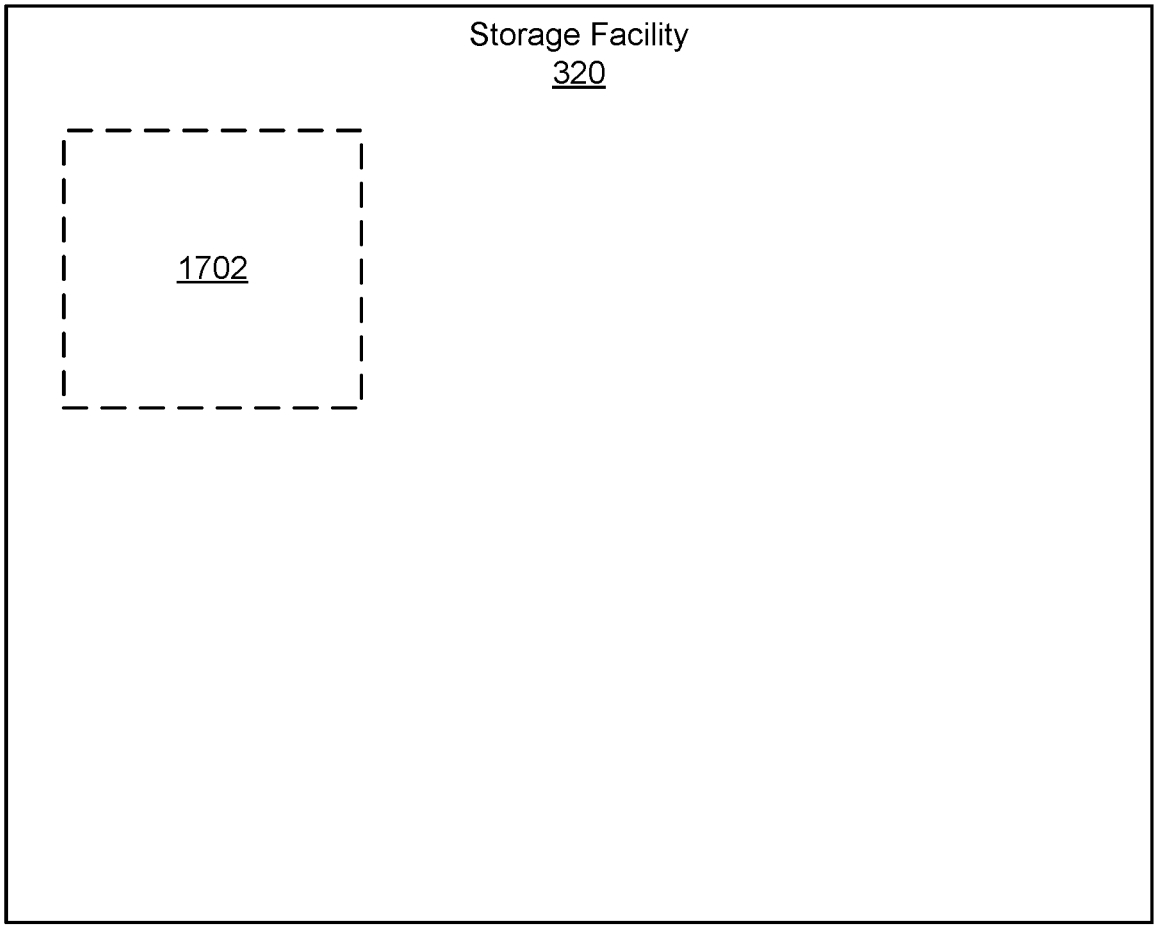
FIGS. 17 through 19 illustrate exemplary aspects of remote loading of a sound processing program onto the sound processor assembly of FIG. 3 according to principles described herein.
Figure 18:
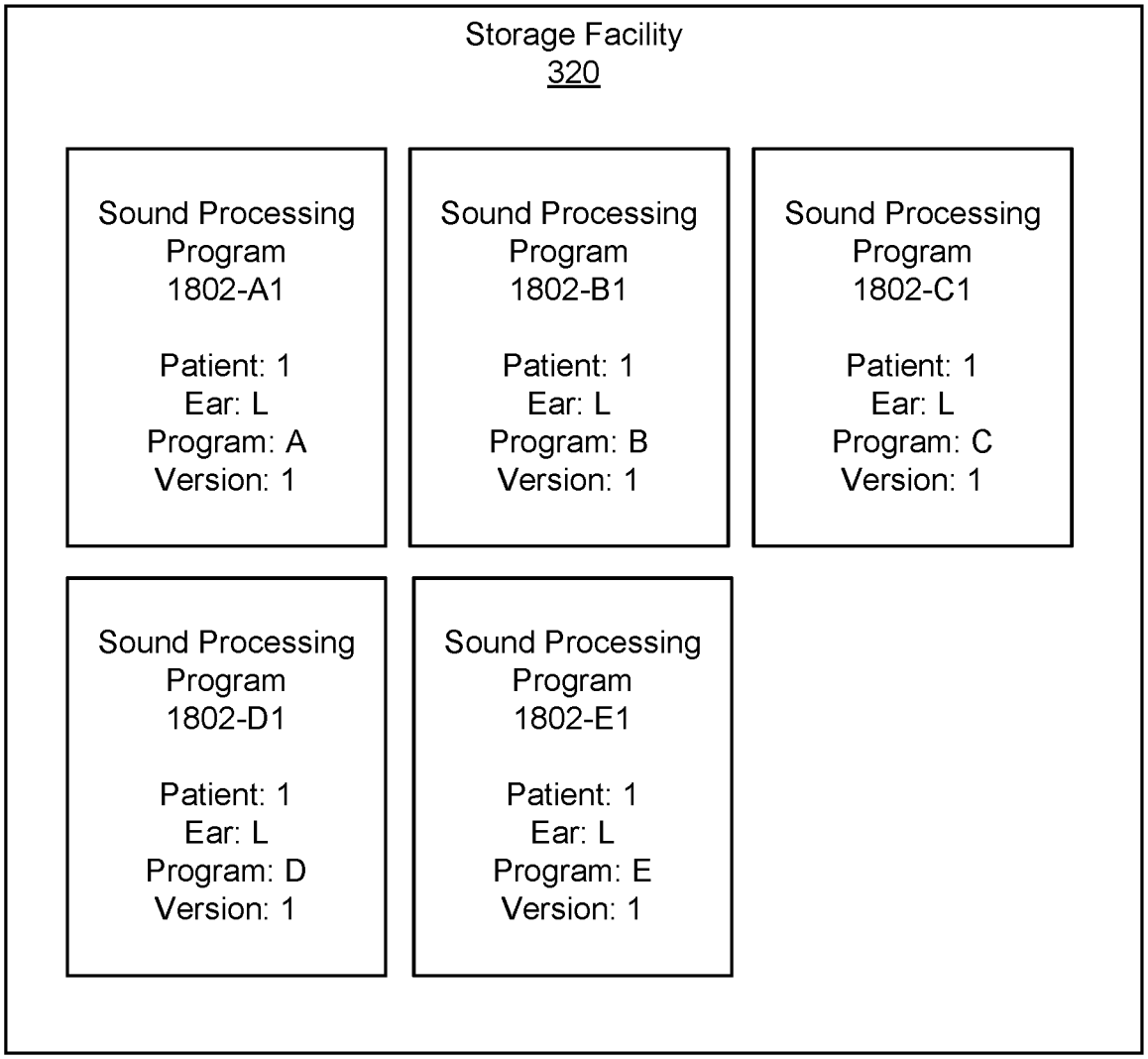
Figure 19:
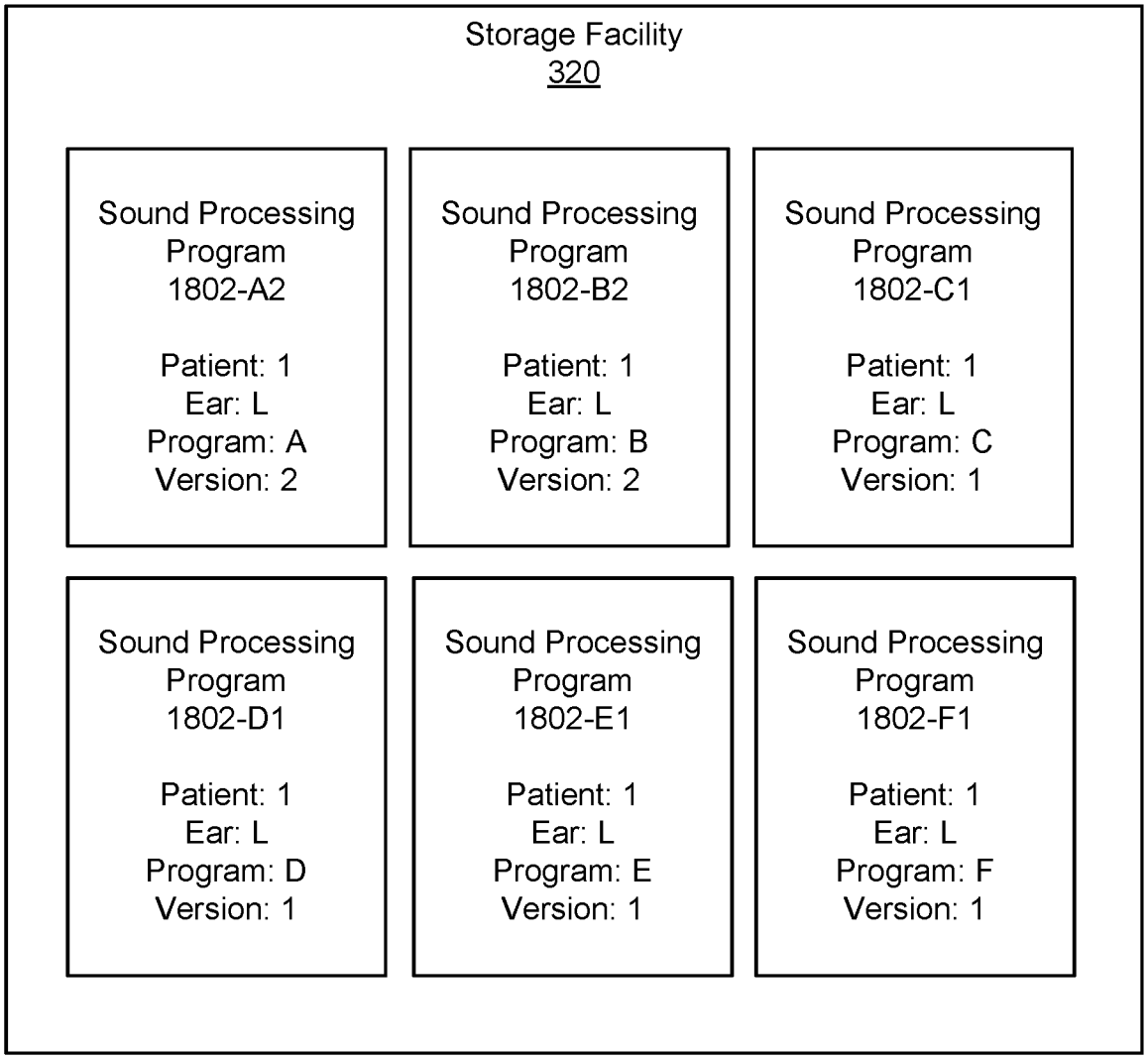

To further illustrate how sound processing programs may be remotely loaded from remote computing system 1502 onto sound processor 302 in accordance with the systems and methods described herein, FIGS. 16-19 show additional details within remote storage facility 1504 of remote computing system 1502 (FIG. 16) and within storage facility 320 of battery assembly 304 (FIGS. 17 through 19).

FIG. 16 shows exemplary components of remote storage facility 1504 of remote computing system 1502. Remote storage facility 1504 may maintain any suitable data representative of one or more sound processing programs, along with any other data received, generated, managed, maintained, used, and/or transmitted by remote computing system 1502 in a particular implementation. As such, remote storage facility 1504 is named using the adjective "remote" to help distinguish it from, for example, the local storage within sound processor 302 and/or battery assembly 304 that is relatively proximate to patient 1512. However, it will be understood that remote storage facility 1504 may be local to remote computing system 1502 and remote from sound processor assembly 300. Remote storage facility 1504 may be implemented by any suitable devices or components as may serve a particular implementation. For instance, if remote computing system 1502 includes a cloud server, remote storage facility 1504 may be implemented by one or more hard drives included within the cloud server or a storage server associated with the cloud server.

FIG. 16 illustrates exemplary components of remote storage facility 1504, including a patient clinical history repository 1602 having several clinical histories 1604 (i.e., clinical histories 1604-1 through 1604-3) and a sound processing program repository 1606 having several sound processing programs 1608 (i.e., sound processing programs 1608-1L, 1608-1R, 1608-2L, 1608-2R, 1608-3L, and 1608-3R). While various data repositories and datasets (e.g., files or the like such as clinical histories 1604 and sound processing programs 1608) are illustrated in FIG. 16, it will be understood that the data shown in FIG. 16 to be included within remote storage facility 1504 is exemplary only, and that more or fewer instances and/or types of data may be included in remote storage facility 1504 in various examples as may serve a particular implementation. Additionally, it will be recognized that although data repositories 1602 and 1606 are shown to be separate data repositories in FIG. 16, these may be functionally combined or divided in any suitable way.

As shown, patient clinical history repository 1602 may store one or more clinical histories 1604 representative of clinical histories of one or more patients (e.g., patients associated with a particular clinician, with a particular clinic, with a particular cochlear implant system manufacturer, etc.). For example, as illustrated, clinical history 1604-1 may be representative of a clinical history of a first patient ("Patient 1"), clinical history 1604-2 may be representative of a clinical history of a second patient ("Patient 2"), and clinical history 1604-3 may be representative of a clinical history of a third patient ("Patient 3").

Each clinical history 1604 may include any information about the clinical history of a respective patient as may serve a particular implementation. For instance, clinical history 1604-1 may include personal information about Patient 1 (e.g., name, contact information, physician information, etc.), information about a cochlear implant system and/or other medical devices used by Patient 1 (e.g., unique identifiers for a cochlear implant implanted within each ear of Patient 1, model numbers and serial numbers for various other cochlear implant system components currently used by Patient 1, etc.), clinical history information previously collected for Patient 1 (e.g., threshold and/or most comfortable levels obtained during fitting sessions, historical and current programming parameters used for the sound processor of Patient 1, historical and current sound processing programs loaded onto and/or used by the sound processor of Patient 1, etc.), and any other relevant information as may serve a particular implementation. Likewise, clinical histories 1604-2 and 1604-3 may include similar data with respect to Patient 2 and Patient 3, respectively.

By including clinical histories 1604 for each patient for whom sound processing programs 1608 are kept in sound processing program repository 1606, remote storage facility 1504 may provide sufficient information for sound processor 302 to discover, request, and load all the sound processing programs that it may be desirable for sound processor 302 to load. For example, if sound processor 302 is a blank sound processor (e.g., a replacement sound processor for a previous sound processor that was lost or broken), sound processor 302 and/or remote computing system 1502 may determine which sound processing programs 1608 from sound processing program repository 1606 are appropriate to load onto sound processor 302 based on information from a particular clinical history 1604. Specifically, by accessing data stored within clinical history 1604-1, sound processor 302 and/or remote computing system 1502 may determine what sound processing programs 1608 were loaded onto a sound processor of Patient 1 (e.g., before the sound processor was lost or broken) and, as such, may cause the same sound processing programs 1608 to be remotely loaded from remote storage facility 1504 to battery assembly 304 according to the methods and systems described above.

Clinical histories 1604 may be secure (e.g., stored as encrypted files or the like) such that clinical histories 1604 may only be read or otherwise accessed based on a validation that sound processor 302 has permission to access the clinical history it is requesting access to. This may be performed at least partly based on unique ID 1002 that sound processor 302 transmits to remote computing system 1502 and the validation of unique ID 1002, as described above. For example, once remote computing system 1502 has validated that unique ID 1002 is valid and is associated with a particular patient for whom there is a clinical history 1604 within patient clinical history repository 1602, remote computing system 1502 may provide sound processor 302 access to the relevant clinical history 1604 to thereby facilitate sound processor 302 in determining which sound processing programs 1608 should be requested and remotely loaded.

Sound processing program repository 1606 may store any sound processing programs 1608 as may serve a particular implementation. For example, as shown, sound processing program repository 1606 may store various sound processing programs 1608, as well as any other sound processing programs or other data as may serve a particular implementation.

Each sound processing program 1608 may be associated with a particular cochlear implant. As such, each sound processing program 1608 may be associated with a particular ear of a patient with which the particular cochlear implant is associated. Sound processing programs 1608 are named and labeled in FIG. 16 to indicate which patient and ear each sound processing program 1608 is associated with. For example, sound processing program 1608-1L is associated with the left ("L") ear of the first patient ("Patient 1"), sound processing program 1608-2R is associated with the right ("R") ear of the second patient ("Patient 2"), and so forth.

Additionally, it will be understood that it may be desirable in various situations for a sound processor to have access to a plurality of sound processing programs associated with a single cochlear implant (e.g., the cochlear implant associated with the particular ear of the particular patient that the sound processor is associated with). For example, sound processing programs associated with various programs (e.g., programs optimized for relatively noisy environments, for relatively quiet environments, for auxiliary audio input, for music listening, etc.) may be available within sound processing program repository 1606 for each cochlear implant (e.g., each patient and ear combination). While such sound processing programs are not explicitly shown in FIG. 16, it will be understood that sound processing program repository 1606 may include them in certain examples. As with other sound processing program notation used herein, such sound processing programs may be distinguished using different letters such as 'A', 'B', 'C', and the like.

FIGS. 17 through 19 illustrate exemplary aspects of remote loading of a sound processing program onto sound processor assembly 300. More particularly, FIGS. 17 through 19 illustrate exemplary components of storage facility 320 within battery assembly 304 of sound processor assembly 300.

For example, FIG. 17 illustrates storage facility 320 of battery assembly 304 when storage facility 320 is blank (e.g., does not yet store any sound processing program). In some examples, as described above, sound processor assembly 300 may be a new sound processor assembly that has never been used to direct a cochlear implant to stimulate a patient. For instance, sound processor 302 may be a blank replacement sound processor that has been shipped to the patient to replace a sound processor that has been lost, broken, or otherwise rendered unusable, and/or battery assembly 304 may be a new battery assembly that does not yet include any customized sound processing programs for the patient. As used herein, a "new sound processor" may refer to a brand new sound processor that has never been used to direct a cochlear implant to stimulate any patient, or a used sound processor (e.g., a previously owned sound processor, a refurbished sound processor, etc.) that is "new" to a particular patient (e.g., a patient now associated with the sound processor) due to the sound processor never having been used to stimulate the particular patient.

In some implementations, battery assembly 304 may include data representative of one or more sound processing programs (e.g., backup copies of the sound processing programs) that may be used by a replacement sound processor 302. However, in certain examples, battery assembly 304 may also be new or may not yet store any sound processing programs prior to the establishment of active network link 1514 and the remote loading of a sound processing program onto sound processor 302 for any of various reasons.

As illustrated by data 1702 in FIG. 17, even though no sound processing programs may yet be stored within storage facility 320, storage facility 320 may not be completely devoid of data in certain implementations. For example, data 1702 may include instructions that, when read and executed by sound processor 302, cause sound processor 302 to establish active network link 1514 with remote computing system 1502 by initiating active network link 1514, to detect unique ID 1002 of cochlear implant 1000, and to otherwise proceed to perform operations described herein to remotely load one or more sound processing programs onto sound processor 302. In other examples, data 1702 may represent other types of data unrelated to sound processing programs as may serve a particular implementation. As used herein, storage facility 320 of battery assembly 304 may be referred to as "blank" when, as in FIG. 17, storage facility 320 does not include any sound processing program, regardless of what other data 1702 may be stored in storage facility 320.

After remotely loading one or more sound processing programs onto sound processor 302 according to the systems and methods described above, battery assembly 304 may store one or more sound processing programs associated with a particular cochlear implant (e.g., the cochlear implant for which sound processor 302 detected the unique ID).

To illustrate, FIG. 18 shows storage facility 320 of battery assembly 304 after the blank storage facility of battery assembly 304 shown in FIG. 17 has received and stored several sound processing programs 1802 (e.g., sound processing programs 1802-A1, 1802-B1, 1802-C1, 1802-D1, and 1802-E1) that were remotely loaded by sound processor 302. In this example, sound processor 302 may be associated with (e.g., worn on, communicatively coupled with a cochlear implant implanted at) a left ear of the patient previously referred to as Patient 1. Accordingly, as shown, each of sound processing programs 1802 are indicated to be associated with "Patient: 1" and "Ear: L".

Additionally, each sound processing program 1802 indicates a particular program and version of the program that is being represented. As described above with respect to sound processing programs 1608 stored in remote storage facility 1504 (see FIG. 16), various types of programs optimized for different environments and/or situations (e.g., relatively noisy or relatively quiet environments, auxiliary audio input, music listening, etc.) may be available for a particular cochlear implant (e.g., a particular ear of a particular patient). These programs are indicated by letters (e.g., "A" through "E") in FIG. 18, and, as shown, each sound processing program 1802 is named to indicate what program type it represents. For example, sound processing program 1802-A1 includes an "A" in the name because sound processing program 1802-A1 represents an "A"-type program for the cochlear implant associated with the left ear of Patient 1, and so forth.

Similarly, sound processing programs 1802 include version numbers for each program. In FIG. 18, the version of each program is "Version: 1". However, it will be understood that each sound processing program may be updated (e.g., by modifying certain parameters represented within the sound processing programs in accordance with a patient's needs and preferences) to new versions. As with the program types, the version numbers of each sound processing program 1802 is indicated in the name of the sound processing program 1802. For example, sound processing program 1802-A1 includes a "1" (after the "A") to indicate that sound processing program 1802-A1 represents Version 1 of Program A.

In some examples, sound processing programs 1802 may be replacement or backup copies of sound processing programs that have previously been used by sound processor 302 (or a predecessor of sound processor 302) and/or stored on battery assembly 304. For example, if sound processor 302 is a new (e.g., replacement) sound processor that takes the place of a lost, broken, or outdated sound processor that was used previously, one or more of sound processing programs 1802 may be sound processing programs that were used by the previous sound processor and that are loaded onto the new sound processor 302 to continue to be used. On the other hand, one or more of sound processing programs 1802 may also be sound processing programs that have never been stored on battery assembly 304 previously, and have never been used by sound processor 302 or a predecessor to sound processor 302. In other words, certain new sound processing programs 1802 may be pushed onto sound processor 302 by remote computing system 1502 (e.g., under direction of a clinician, manufacturer, etc.) to help or encourage a patient to try new or different sound processing programs (e.g., or new versions of sound processing programs), or for other reasons.

To illustrate, FIG. 19 shows storage facility 320 after new versions of certain sound processing programs and a new sound processing program have been remotely loaded onto storage facility 320 of battery assembly 304. Specifically, as shown in FIG. 19, sound processing program 1802-A1 has been replaced by a sound processing program 1802-A2, which is a new version (i.e., Version 2) of Program A for the left ear of Patient 1. Similarly, sound processing program 1802-B1 has similarly been replaced by a sound processing program 1802-132, which is a new version (i.e., Version 2) of Program B for the left ear of Patient 1. Moreover, sound processing program 1802-F1, a new sound processing program that has never been used by sound processor 302 or stored on battery assembly 304 previously, has also been stored in storage facility 320 of battery assembly 304 along with the other sound processing programs 1802.

Prior to the storage of sound processing programs 1802-A2 and 1802-B2 (e.g., in the example of FIG. 18, above, where sound processing programs 1802-A1 and 1802-B1 were stored), storage facility 320 may have stored data representative of non-preferred versions of the sound processing program. For example, Version 1 of Program A and Version 1 of Program B may have been non-preferred because they were out of date, included one or more bugs, discrepancies, or other issues, or for other reasons. Accordingly, sound processing programs 1802-A2 and 1802-132, which are shown to replace sound processing programs 1802-A1 and 1802-B1, respectively, in storage facility 320 in FIG. 19, may be preferred versions of the respective sound processing programs. For example, sound processing programs 1802-A2 and/or 1802-B2 may be more up to date than their respective predecessors, or may include bug fixes or the like to resolve prior issues of the non-preferred versions.

Figure 20:
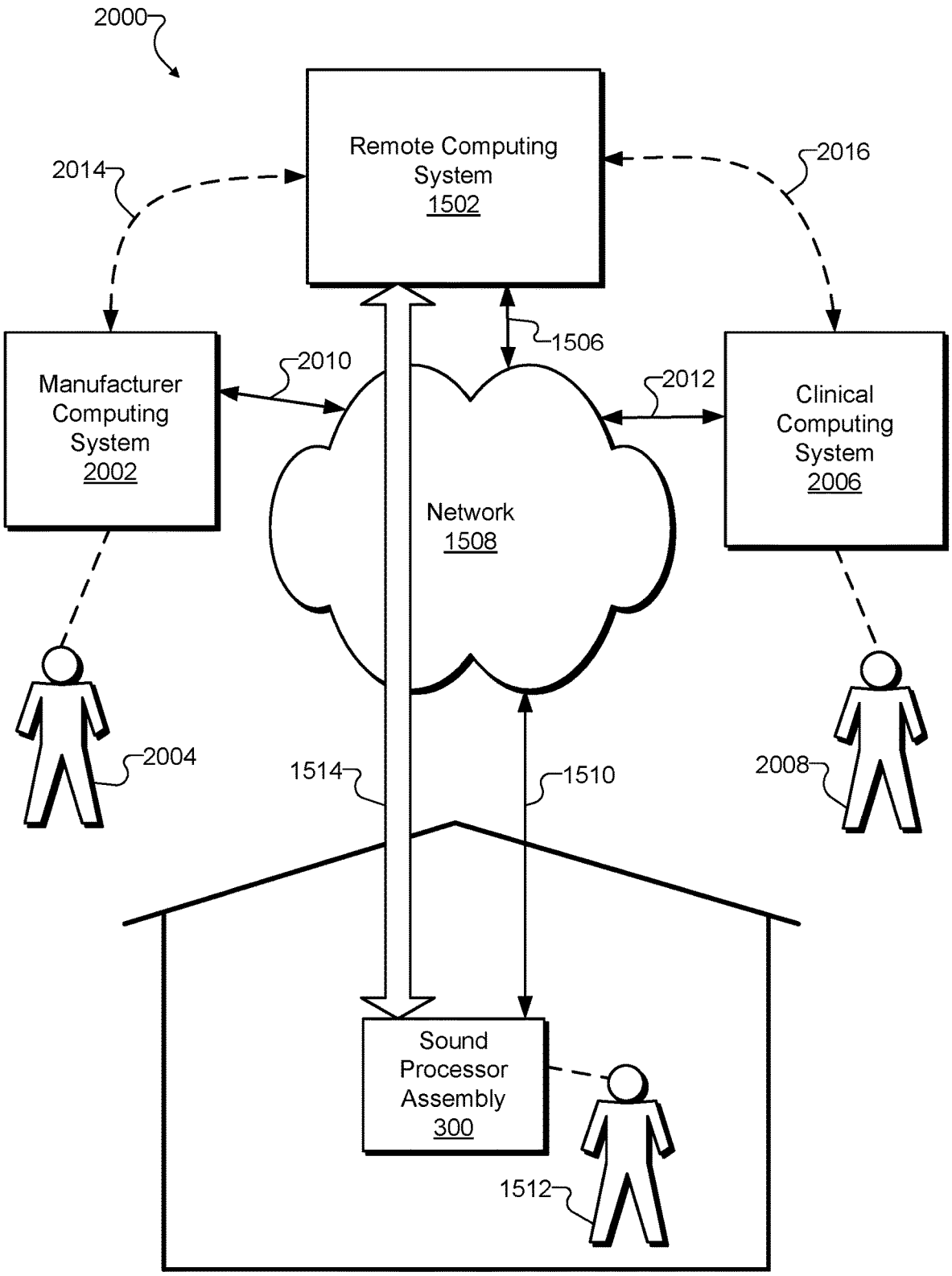
FIG. 20 illustrates another exemplary configuration in which the sound processor assembly of FIG. 3 and the remote computing system of FIG. 15 interoperate to remotely load a sound processing program onto the sound processor assembly according to principles described herein.

As described above, FIG. 15 illustrated one configuration (i.e., configuration 1500) in which sound processor assembly 300 (i.e., sound processor 302 and battery assembly 304) and remote computing system 1502 interoperate to remotely load a sound processing program onto sound processor 302 while sound processor 302 is located remotely from remote computing system 1502. Along the same lines, FIG. 20 shows another exemplary configuration 2000 in which sound processor assembly 300 and remote computing system 1502 interoperate to remotely load a sound processing program onto sound processor assembly 300 (e.g., onto sound processor 302 within sound processor assembly 300 in particular). However, configuration 2000 of FIG. 20 shows additional details not illustrated in FIG. 15 related to communications with other entities (e.g., clinical personnel, manufacturing personnel, technicians, respective computing systems associated with these parties, and the like) that may occur as part of the remote loading.

Specifically, like FIG. 15, FIG. 20 shows that the illustrated cochlear implant system including sound processor assembly 300 and cochlear implant 1000 is located along with patient 1512 in a location (e.g., such as the home of patient 1512) that is remote from a location where remote computing system 1502 is located. Between the cochlear implant system and remote computing system 1502 is network 1508, with which both sound processor assembly 300 and remote computing system 600 are communicatively coupled (i.e., by way of connections 1510 and 1506, respectively). Active network link 1514 also connects remote computing system 1502 and sound processor assembly 300 by way of network 1508, as described above.

Along with these elements common to configuration 1500, configuration 2000 also includes various new elements. For example, as shown, configuration 2000 includes a manufacturing computing system 2002 associated with manufacturing personnel 2004, and a clinical computing system 2006 associated with clinical personnel 2008. As further shown, manufacturer computing system 2002 may be communicatively coupled with network 1508 by way of a connection 2010, while clinical computing system 2006 may be communicatively coupled with network 1508 by way of a connection 2012.

As described above with respect to FIG. 15, sound processor 302 within sound processor assembly 300 may detect a unique ID of a cochlear implant associated with patient 1512, and sound processor 302 and remote computing system 1502 may establish an active network link 1514 by way of network 1508. In some examples, the establishment of active network link 1514 is initiated by sound processor 302, while, in other examples, the establishment of active network link 1514 is initiated by remote computing system 1502.

Once the unique ID of the cochlear implant is detected, sound processor 302 may transmit the unique ID to remote computing system 1502 over active network link 1514, and remote computing system 1502 may receive the unique ID, as described above. Based on the unique ID, remote computing system 1502 may identify a sound processing program associated with the cochlear implant represented by the unique ID (e.g., from the repository of sound processing programs in remote storage facility 1504), and may transmit data representative of the identified sound processing program to sound processor 302 over active network link 1514 to be received by sound processor 302. In response to the transmission of the data representative of the identified sound processing program, remote computing system 1502 may update a patient history for patient 1512 (e.g., a clinical history 1604 associated with patient 1512 from patient clinical history repository 1602, described above in relation to FIG. 16) to indicate that the identified sound processing program has been loaded onto sound processor 302.

Additionally, remote computing system 1502 may provide data representative of a patient file update to a computing system associated with a clinician of the patient (e.g., clinical computing system 2006), to a computing system associated with a manufacturer of the sound processor (e.g., manufacturing computing system 2002), or to another similar system. For example, the data representative of the patient file update may include a record of the transmission of the data representative of the identified sound processing program to the sound processing program. The record may include, for instance, information related to what sound processing program was requested, what cochlear implant unique ID was provided, what sound processing program (e.g., name, version number, etc.) was transmitted, when the sound processing program was requested and/or transmitted, and/or any other information as may serve a particular implementation.

Manufacturer computing system 2002 and/or manufacturing personnel 2004 may be associated with a manufacturer, distributor, reseller, retail outlet, or other entity that may provide (e.g., sell or otherwise distribute) a sound processor used by patient 1512 (e.g., sound processor 302 within sound processor assembly 300). In some examples, manufacturer computing system 2002 and/or manufacturing personnel 2004 may be associated with a company that designs and manufactures cochlear implant systems (e.g., including sound processor assembly 300), or may be closely associated with such a company. In alternative examples, manufacturer computing system 2002 and/or manufacturing personnel 2004 may provide components of the cochlear implant system (e.g., including sound processor assembly 300), but may not actually be responsible for the design or manufacture of the cochlear implant system components.

Similarly, clinical computing system 2006 and clinical personnel 2008 may be associated with any clinic, business, practice, or other entity that works with patients such as patient 1512 to program (e.g., fit) cochlear implant systems to the patients. For example, clinical personnel 2008 may work with patients to determine characteristics of the patients' unique hearing abilities, preferences, etc., and may program the patients' respective cochlear implant systems to operate in accordance with these characteristics. As such, patient 1512 may attend periodic appointments at the programming clinic to allow clinical personnel 2008 to determine, track, and promote the progress of patient 1512 with respect to the cochlear implant system. To this end, clinical computing system 2006 may store and/or update records related to patient 1512 (e.g., including the patient file updates with the record of the transmission of the data representative of the identified sound processing program described above), and related to the progress of patient 1512 with respect to the cochlear implant system. For example, records of the progress of patient 1512, along with past and current sound processing programs, past and current characteristics unique to the patient's hearing abilities and preferences, and other suitable data specific to patient 1512 may be maintained within clinical computing system 2006 (e.g., by clinical personnel 2008).

Connections 2010 and 2012 may be implemented by any suitable connections as may serve a particular implementation. For example, as with connections 1506 and 1510, connections 2010 and 2012 may be implemented by, for instance, a wireless connection, a wired connection, by way of another device, or by way of any other type of connection as may serve a particular implementation. In some examples, as illustrated by dashed arrows 2014 and 2016, respectively, remote computing system 1502 may optionally be integrated within (e.g., implemented by, included as part of, etc.) at least one of manufacturer computing system 2002 and clinical computing system 2006. As such, remote computing system 1502 may be owned, operated, and/or otherwise associated with manufacturing personnel 2004 and/or clinical personnel 2008, and data may be transmitted directly between remote computing system 1502 and the respective computing system (e.g., without travelling by way of network 1508). In other examples, remote computing system 1502 may be managed and maintained by a third party not directly or closely tied to the manufacturer or the programming clinic.

After a sound processing program has been identified, transmitted, recorded and/or reported by remote computing system 1502, sound processor assembly 300 may receive the sound processing program over active network link 1514, as described above in relation to FIG. 15. In some examples, the sound processing program may have never been stored on the local storage facility associated with sound processor assembly 300 (e.g., storage facility 314 of sound processor 302, storage facility 320 of battery assembly 304, etc.) prior to this moment, whereas, in other examples, the sound processing program may be reloaded onto sound processor 302 after sound processor 302 has experienced issues and/or been replaced. Regardless, at the time that a particular sound processing program is transmitted to sound processor assembly 300, the local storage facility may be blank (see FIG. 17) or may store data representative of at least one additional sound processing program (see FIG. 18).

One benefit of having remote computing system 1502 interconnected by way of network 1508 with both manufacturer computing system 2002 and clinical computing system 2006 is that, if patient 1512 experiences issues with the remote loading of the sound processing program or has questions or the like, systems 2002 or 2006, or personnel 2004 or 2008, may be called upon to provide assistance to patient 1512 to ensure that the remote loading process goes smoothly. For example, if patient 1512 experiences a problem with remotely loading a particular sound processing program, patient 1512 may access help documentation available on one of systems 2002 or 2006, or may page an on-call technician included among personnel 2004 or 2008 for assistance. Ultimately, the interconnectedness of the various parties and systems in FIG. 20 may help provide a smooth, user-friendly experience to enable patient 1512 to remotely load all the sound processing programs he or she desires onto sound processor 302, and to efficiently troubleshoot issues as they arise.

Figure 21:
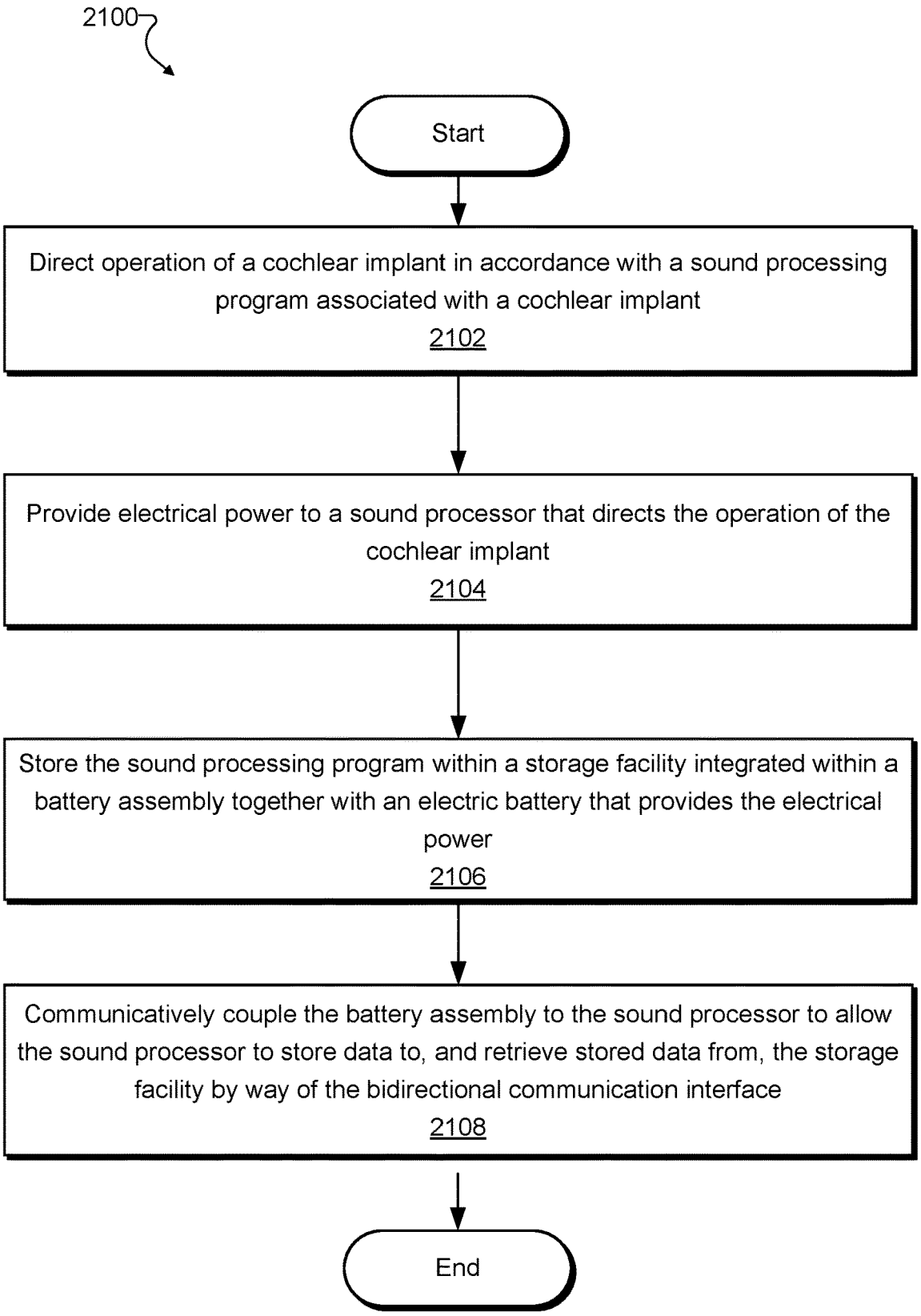
FIG. 21 illustrates an exemplary battery-based method for managing sound processor programming for a cochlear implant system according to principles described herein.

FIG. 21 illustrates an exemplary battery-based method for managing sound processor programming for a cochlear implant system. One or more of the operations shown in FIG. 21 may be performed sound processor assembly 300, a component included therein (e.g., sound processor 302, battery assembly 304, etc.), or any implementation thereof. While FIG. 21 illustrates exemplary operations according to one embodiment, other embodiments may omit, add to, reorder, and/or modify any of the operations shown in FIG. 21.

In operation 2102, a sound processor within a sound processor assembly included within a cochlear implant system directs operation of a cochlear implant in accordance with a sound processing program associated with the cochlear implant. For example, the cochlear implant may be implanted within a patient and may be further included, with the sound processor assembly, within the cochlear implant system. Operation 2102 may be performed in any of the ways described herein.

In operation 2104, an electric battery within a battery assembly included within the sound processor assembly provides electrical power to the sound processor that directs the operation of the cochlear implant in operation 2102. Operation 2104 may be performed in any of the ways described herein.

In operation 2106, a storage facility integrated with the electric battery within the battery assembly stores the sound processing program associated with the cochlear implant. Operation 2106 may be performed in any of the ways described herein.

In operation 2108, a bidirectional communication interface included within the battery assembly communicatively couples the battery assembly to the sound processor. In this way, for example, the bidirectional communication interface may allow the sound processor to store data to, and retrieve stored data from, the storage facility by way of the bidirectional communication interface. Operation 2108 may be performed in any of the ways described herein.

In the preceding description, various exemplary embodiments have been described with reference to the accompanying drawings. It will, however, be evident that various modifications and changes may be made thereto, and additional embodiments may be implemented, without departing from the scope of the invention as set forth in the claims that follow. For example, certain features of one embodiment described herein may be combined with or substituted for features of another embodiment described herein. The description and drawings are accordingly to be regarded in an illustrative rather than a restrictive sense.

What is claimed is:

1. A sound processor assembly included within a cochlear implant system, the sound processor assembly comprising:

a sound processor housed within a first enclosure and including at least one physical computing device configured to direct operation of a cochlear implant in accordance with a sound processing program associated with the cochlear implant, the cochlear implant implanted within a patient and further included, with the sound processor assembly, within the cochlear implant system; and a battery assembly housed within a second enclosure that is removably-couplable to the first enclosure to physically couple the battery assembly to the sound processor, the battery assembly including an electric battery configured to provide electrical power to the sound processor;

a storage facility configured to store the sound processing program associated with the cochlear implant, the storage facility integrated with the electric battery within the second enclosure; and a bidirectional communication interface configured to communicatively couple the battery assembly to the sound processor to allow the sound processor to store data to, and retrieve stored data from, the storage facility by way of the bidirectional communication interface.

2. The sound processor assembly of claim 1, wherein the at least one physical computing device is further configured to synchronize the sound processor and the storage facility of the battery assembly by detecting an availability of an active communication link between the sound processor and the battery assembly by way of the bidirectional communication interface;

determining, by way of communication with the battery assembly over the active communication link, that the sound processing program is included on only one of the sound processor and the storage facility of the battery assembly; and initiating, in response to the determination, a synchronization transfer of the sound processing program by way of the active communication link to cause the sound processing program to be included on both the sound processor and the storage facility of the battery assembly.

3. The sound processor assembly of claim 2, wherein the initiation of the synchronization transfer of the sound processing program is performed by:

automatically determining that the sound processing program is included on the sound processor and not on the storage facility of the battery assembly; and uploading, in response to the automatic determination that the sound processing program is included on the sound processor and not on the storage facility of the battery assembly, the sound processing program to the storage facility of the battery assembly by way of the active communication link.

4. The sound processor assembly of claim 3, wherein:

the sound processing program automatically determined to be included on the sound processor and not on the storage facility of the battery assembly is a preferred version of a particular sound processing program associated with the cochlear implant;

the initiation of the synchronization transfer of the sound processing program is further performed by automatically determining that a non-preferred version of the particular sound processing program associated with the cochlear implant is included on the storage facility of the battery assembly; and the uploading of the sound processing program to the storage facility of the battery assembly comprises transmitting, to the battery assembly by way of the active communication link, data representative of the preferred version of the particular sound processing program and of a command for the battery assembly to replace, on the storage facility, the non-preferred version of the particular sound processing program with the preferred version of the particular sound processing program.

5. The sound processor assembly of claim 2, wherein the initiation of the synchronization transfer of the sound processing program is performed by:

automatically determining that the sound processing program is included on the storage facility of the battery assembly and not on the sound processor; and downloading, in response to the automatic determination that the sound processing program is included on the storage facility of the battery assembly and not on the sound processor, the sound processing program from the battery assembly by way of the active communication link.

6. The sound processor assembly of claim 5, wherein:

the sound processing program automatically determined to be included on the storage facility of the battery assembly and not on the sound processor is a preferred version of a particular sound processing program associated with the cochlear implant;

the initiation of the synchronization transfer of the sound processing program is further performed by automatically determining that a non-preferred version of the particular sound processing program associated with the cochlear implant is included on the sound processor; and the downloading of the sound processing program from the battery assembly comprises receiving, from the battery assembly by way of the active communication link, data representative of the preferred version of the particular sound processing program, and replacing, based on the received data representative of the preferred version of the particular sound processing program, the non-preferred version of the particular sound processing program with the preferred version of the particular sound processing program.

7. The sound processor assembly of claim 2, wherein the storage facility of the battery assembly stores a plurality of sound processing programs, the plurality of sound processing programs including at least two alternative sound processing programs associated with the cochlear implant implanted within the patient.

8. The sound processor assembly of claim 2, wherein the storage facility of the battery assembly stores a plurality of sound processing programs, the plurality of sound processing programs including:

at least one sound processing program associated with the cochlear implant implanted within the patient; and at least one sound processing program associated with a contralateral cochlear implant also implanted within the patient.

9. The sound processor assembly of claim 2, wherein the storage facility of the battery assembly stores a plurality of sound processing programs, the plurality of sound processing programs including:

at least one sound processing program associated with the cochlear implant implanted within the patient; and at least one sound processing program associated with a different cochlear implant implanted within a different patient.

10. The sound processor assembly of claim 1, wherein the at least one physical computing device is further configured to remotely load the sound processing program onto the battery assembly by detecting a unique identifier of the cochlear implant;

establishing, by way of a network, and active network link with a remote computing system located remotely from the cochlear implant system;

transmitting, to the remote computing system by way of the network and over the active network link, the unique identifier of the cochlear implant;

receiving, in response to the transmission of the unique identifier, data representative of the sound processing program associated with the cochlear implant, the data received from the remote computing system by way of the network and over the active network link; and storing the received data representative of the sound processing program on the storage facility of the battery assembly by way of the bidirectional communication interface.

11. The sound processor assembly of claim 10, wherein:

the sound processor is a new sound processor that has never been used, prior to the establishment of the active network link, to direct the operation of the cochlear implant;

the establishment of the active network link with the remote computing system is initiated by the sound processor; and prior to the storage of the received data representative of the sound processing program, the storage facility of the battery assembly does not yet store any sound processing programs.

12. The sound processor assembly of claim 10, wherein:

prior to the storage of the received data representative of the sound processing program, the storage facility of the battery assembly stores data representative of a non-preferred version of a particular sound processing program; and the sound processing program is a preferred version of the particular sound processing program that replaces the non-preferred version of the particular sound processing program on the storage facility of the battery assembly.

13. The sound processor assembly of claim 10, wherein:

the establishment of the active network link with the remote computing system is initiated by the remote computing system; and prior to the storage of the received data representative of the sound processing program, the storage facility of the battery assembly stores data representative of at least one additional sound processing program.

14. The sound processor assembly of claim 10, wherein:

subsequent to the storage of the sound processing program of the storage facility of the battery assembly, the at least one physical computing device activates the sound processing program on the sound processor by retrieving the sound processing program from the storage facility of the battery assembly by way of the bidirectional communication interface, and directing the cochlear implant to stimulate the patient in accordance with the sound processing program.

15. A battery assembly comprising:

an electric battery configured to provide electrical power to a sound processor housed within a first enclosure and included within a cochlear implant system along with a cochlear implant implanted within a patient, the sound processor configured to direct operation of the cochlear implant in accordance with a sound processing program associated with the cochlear implant;

a second enclosure housing the electric battery and removably-couplable to the first enclosure to physically couple the battery assembly to the sound processor;

a storage facility configured to store the sound processing program associated with the cochlear implant, the storage facility integrated with the electric battery within the second enclosure; and a bidirectional communication interface configured to communicatively couple the battery assembly to the sound processor to allow the sound processor to store date to, and retrieve stored date from, the storage facility by way of the bidirectional communication interface.

16. A method comprising:

directing, by a sound processor housed within a first enclosure and included within a sound processor assembly of a cochlear implant system, operation of a cochlear implant in accordance with a sound processing program associated with the cochlear implant, the cochlear implant implanted within a patient and further included, with the sound processor assembly, within the cochlear implant system;

providing, by an electric battery within a battery assembly housed within a second enclosure that is removably-couplable to the first enclosure to physically couple the battery assembly to the sound processor and that is also included within the sound processor assembly, electrical power to the sound processor;

storing, by a storage facility integrated with the electric batter within the second enclosure, the sound processing program associated with the cochlear implant; and communicatively coupling, by a bidirectional communication interface included within the battery assembly, the batter assembly to the sound processor to allow the sound processor to store data to, and retrieve stored date form, the storage facility by way of the bidirectional communication interface.

17. The method of claim 16, further comprising:

detecting, by the sound processor within the sound processor assembly, and availability of an active communication link between the sound processor and the battery assembly by way of the bidirectional communication interface;

determining, by the sound processor within the sound processor assembly and by way of communication with the battery assembly over the active communication link, that the sound processing program is included on only one of the sound processor and the storage facility of the battery assembly; and initiating, by the sound processor within the sound processor assembly and in response to the determining, a synchronization transfer of the sound processing program by way of the active communication link to cause the sound processing program to be included on both the sound processor and the storage facility of the battery assembly.

18. The method of claim 17, wherein the initiating of the synchronization transfer of the sound processing program comprises:

automatically determining that the sound processing program is included on the sound processor and not on the storage facility of the battery assembly; and uploading in response to the automatic determination that the sound processing program is included on the sound processor and not on the storage facility of the battery assembly, the sound processing program to the storage facility of the battery assembly by way of the active communication link.

19. The method of claim 17, wherein the initiating of the synchronization transfer of the sound processing program comprises:

automatically determining that the sound processing program is included on the storage facility of the battery assembly and not on the sound processor; and downloading, in response to the automatic determination that the sound processing program is included on the storage facility of the battery assembly and not on the sound processor, the sound processing program from the battery assembly by way of the active communication link.

20. The method of claim 16, further comprising:

detecting, by the sound processor within the sound processor assembly, a unique identifier of a cochlear implant;

establishing, by the sound processor within the sound processor assembly and by way of a network an active network link with a remote computing system located remotely from the cochlear implant system;

transmitting, by the sound processor within the sound processor assembly, the unique identifier of the cochlear implant to the remote computing system by way of the network and over the active network link;

receiving, by the sound processor within the sound processor assembly and in response to the transmitting of the unique identifier, data representatives of the sound processing program associated with the cochlear implant, the data received from the remote computing system by way of the network and over the active network link; and storing, by the sound processor within the sound processor assembly, the received data representative of the sound processing program on the storage facility of the battery assembly by way of the bidirectional communication interface.

* * * * *